US008226193B2

(12) United States Patent
Sugahara

(10) Patent No.: US 8,226,193 B2
(45) Date of Patent: Jul. 24, 2012

(54) LIQUID DROPLET JETTING APPARATUS

(75) Inventor: Hiroto Sugahara, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 12/542,444

(22) Filed: Aug. 17, 2009

(65) Prior Publication Data

US 2010/0045716 A1 Feb. 25, 2010

(30) Foreign Application Priority Data

Aug. 21, 2008 (JP) ..... 2008-212799

(51) Int. Cl.
*B41J 29/38* (2006.01)

(52) U.S. Cl. ..... 347/13; 347/5; 347/9; 347/12; 347/42

(58) Field of Classification Search ..... None
See application file for complete search history.

(56) References Cited

U.S. PATENT DOCUMENTS

| | | | | |
|---|---|---|---|---|
| 6,481,820 | B1 * | 11/2002 | Tamura et al. | 347/19 |
| 2003/0058289 | A1 * | 3/2003 | Yamada et al. | 347/12 |
| 2003/0142161 | A1 * | 7/2003 | Miura et al. | 347/19 |
| 2007/0296757 | A1 * | 12/2007 | Mills et al. | 347/42 |
| 2010/0156975 | A1 * | 6/2010 | Morooka | 347/14 |

FOREIGN PATENT DOCUMENTS

| | | |
|---|---|---|
| JP | 11-334047 | 12/1999 |
| JP | 2005-280050 | 10/2005 |
| JP | 2005-74956 | 3/2006 |
| JP | 2006-69028 | 3/2006 |

* cited by examiner

*Primary Examiner* — Matthew Luu
*Assistant Examiner* — Justin Seo
(74) *Attorney, Agent, or Firm* — Frommer Lawrence & Haug LLP

(57) ABSTRACT

There is provided a liquid droplet jetting apparatus which jets liquid droplets on to an object, including a transporting mechanism which transports the object along a transporting path extended in a predetermined transporting direction, two heads, each having a plurality of nozzles arranged in a row along a direction intersecting the transporting direction, which jet liquid droplets from the plurality of nozzles while maintaining relative positions of the two heads, and a head relative-position changer which switches the relative positions of the two heads to a predetermined first relative position, and a second relative position which is different from the first relative position in the direction intersecting.

11 Claims, 18 Drawing Sheets

LIQUID DROPLET JETTING APPARATUS

CROSS REFERENCE TO RELATED APPLICATION

The present application claims priority from Japanese Patent Application No. 2008-212799, filed on Aug. 21, 2008, the disclosure of which is incorporated herein by reference in its entirety.

BACKGROUND OF THE INVENTION

1. Field of the Invention

The present invention relates to a liquid droplet jetting apparatus which jets liquid droplets from nozzles.

2. Description of the Related Art

An ink-jet printer which includes a line head, an auxiliary head which has a structure similar to the line head, and a laser nozzle checking mechanism for checking a jetting-defect in a nozzle of the ink-jet head has hitherto been known. At the time of carrying out printing, firstly, a checking of whether or not there is a defective nozzle having a jetting defect is carried out by the laser nozzle checking mechanism, and when there is a defective nozzle, the defective nozzle can be identified. Moreover, when there is no defect in a nozzle, printing is carried out on a recording paper by jetting an ink, from the nozzles of the line head, onto a recording paper transported by a pair of transporting rollers. On the other hand, when there is a defective nozzle, printing is carried out by jetting the ink not from the nozzles of the line head, but from the nozzles of the auxiliary head. Alternatively, printing is carried out by jetting the ink from nozzles without defect of the line head and from an auxiliary nozzle corresponding to the defective nozzle of the line head. Accordingly, even when there is a jetting-defect in a nozzle of the line head, an occurrence of a defect in an image to be printed is prevented.

SUMMARY OF THE INVENTION

In the above-mentioned ink-jet printer, in spite of the comparatively large size auxiliary head similar to the line head which is provided separately, since the auxiliary head is used only for supplementing a jetting-defect in a nozzle of the line head, an image quality of an image to be printed and a speed of printing are same as in a case when the printing is carried out only by a line head having no defective nozzle.

Moreover, in the above-mentioned ink-jet printer, when there is a jetting-defect in a nozzle of the auxiliary head corresponding to the defective nozzle, in addition to the presence of a defective nozzle in the line head, a lined area (striped area) on which the ink does not land is developed on a recording paper, at a position where the ink jetted from the defective nozzle of the line head is supposed to land.

Moreover, when there is no jetting-defect in a nozzle of the line head, in spite of a fact that a comparatively large size auxiliary head having a structure similar to the line head is provided, the auxiliary head is not at all used. Whereas, in a case in which there is a jetting-defect in a nozzle of the line head, when the ink is jetted only from a nozzle of the auxiliary head, the line head in which a multiple number of nozzles except the defective nozzle are normal is not used. Further, when the ink is jetted only from a nozzle of the auxiliary head corresponding to the defective nozzle, the multiple number of nozzles of the auxiliary head are not used. Furthermore, in any of the above-mentioned cases, the multiple number of normal nozzles of the auxiliary head or the line head is not used, and is wasted.

An object of the present invention is to provide a liquid droplet jetting apparatus in which it is possible to output a high quality image without lowering an efficiency, by using two heads.

According to an aspect of the present invention, there is provided a liquid droplet jetting apparatus which jets liquid droplets on to an object, including a transporting mechanism which transports the object along a transporting path extended in a predetermined transporting direction, two heads, each having a plurality of nozzles arranged in a row along a direction intersecting (a direction orthogonal to) the transporting direction, which jet liquid droplets from the plurality of nozzles while maintaining relative positions of the two heads, and a head relative-position changer which switches the relative positions of the two heads to a predetermined first relative position, and a second relative position which is different from the first relative position in the direction intersecting.

According to the aspect of the present invention, by moving the two heads relatively in the direction intersecting the transporting direction, it is possible to carry out switching to a high-speed liquid droplet jetting and a precise liquid droplet jetting. Furthermore, for instance, when there occurs a defect in a nozzle, supplementing of the defective nozzle also becomes possible.

DETAILED DESCRIPTION OF THE PREFERRED EMBODIMENTS

First Embodiment

Figure 1:
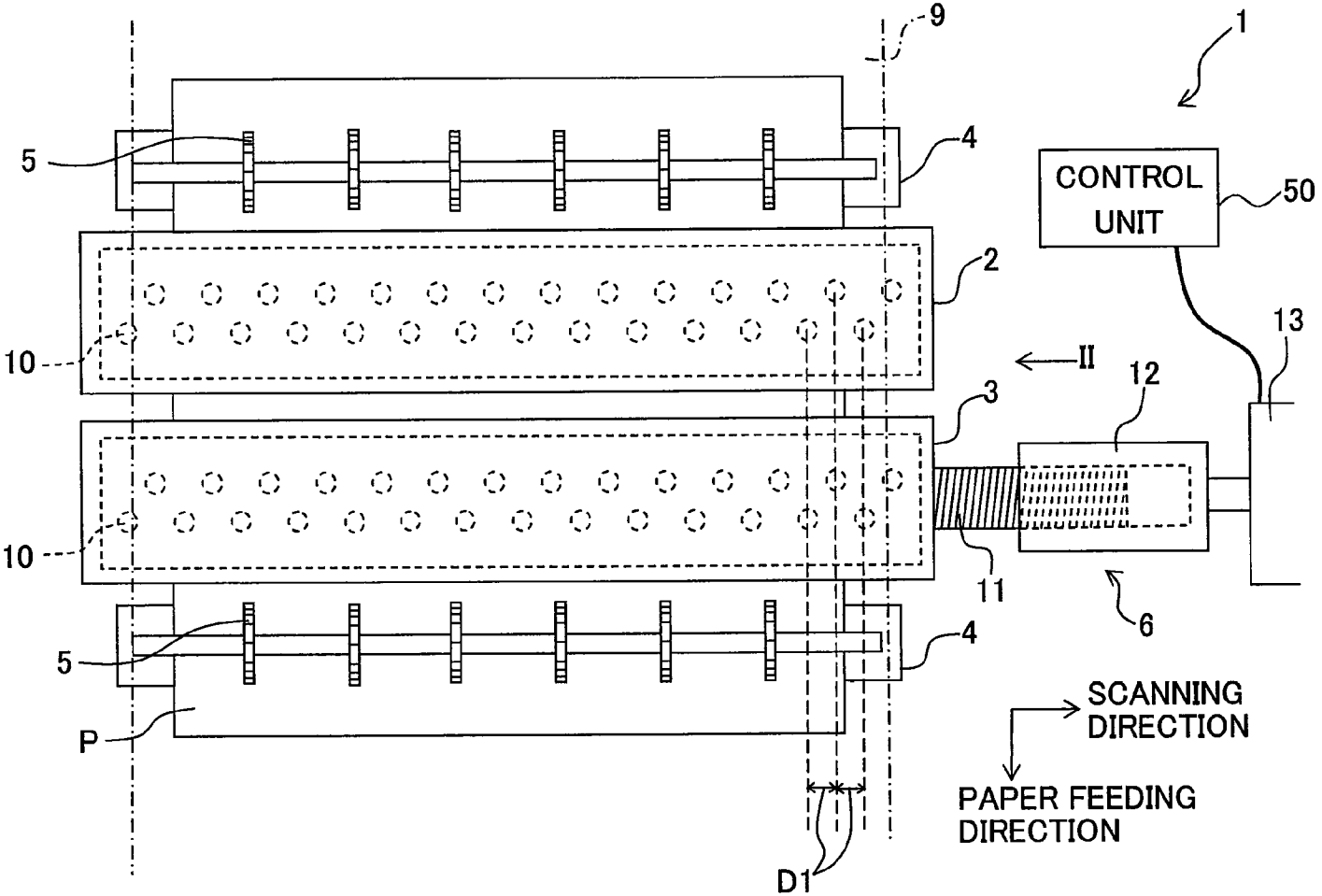
FIG. 1 is a schematic cross-sectional view of a printer according to a first embodiment, when viewed from a top.
Figure 2:
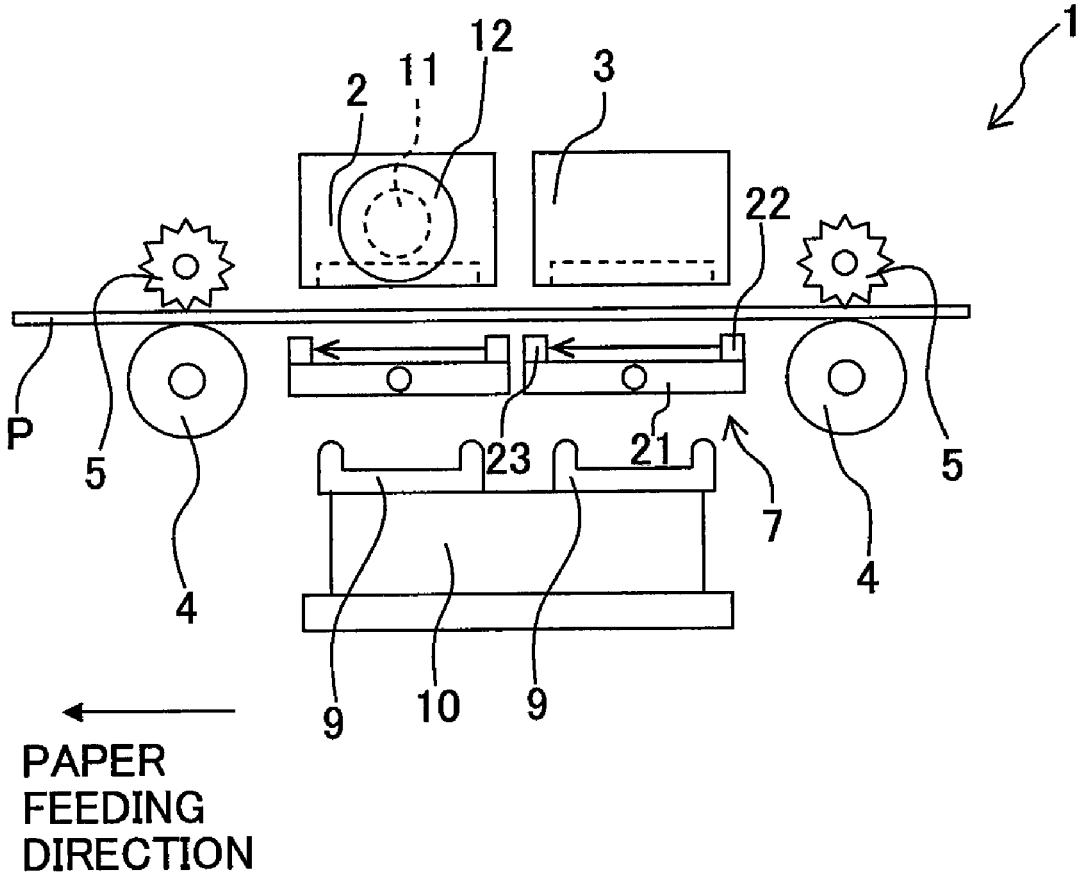
FIG. 2 is a side view when the printer is viewed from a direction of an arrow II.

A first embodiment which is an exemplary embodiment of the present invention will be described below. Note that a motor which will be described later is not shown in FIG. 2. As shown in FIGS. 1 and 2, a printer 1 includes two line heads 2 and 3, two transporting rollers 4, two spur-rollers 5, a head moving mechanism 6, and a defective-nozzle detecting unit 7. Moreover, an operation of the printer 1 is controlled by the control unit 50.

The two line heads 2 and 3 are extended in a scanning direction (left-right direction in FIG. 1) orthogonal to (intersecting) a paper feeding direction (a vertical direction in FIG. 1) in which a recording paper P (object subjected to jetting) is transported, and is extended to be sticking out up to an outer side of the recording paper P on both sides in the scanning direction. An ink of same color (black color ink in the first embodiment) is jetted from a plurality of nozzles 10 arranged in a row at an equal interval D in the scanning direction on a lower surface thereof. Here, the nozzles 10 of the line head 2 and the nozzles 10 of the line head 3 are arranged to be overlapping mutually when viewed from the paper feeding direction.

Moreover, the line head 2 arranged at an upper side in FIG. 1 is fixed to the printer 1 (a transporting path 9 that will be described later), and the line head 3 arranged at a lower side in FIG. 1 is movable in the scanning direction. Accordingly, the line head 2 and the line head 3 are relatively movable in the scanning direction.

In this manner, by letting the line head 2 to be fixed to the printer 1, and moving the line head 3 in the scanning direction, the line head 2 and the line head 3 are moved relatively in the scanning direction. Therefore, the head moving mechanism 6 may be provided only to the line head 3, and a structure of the printer 1 becomes simple.

The transporting rollers 4 are arranged sandwiching the line heads 2 and 3 in the paper feeding direction, and facing a lower surface of the transported recording paper P. A motor which is not shown in the diagram is connected to the transporting rollers 4, and the transporting rollers 4 are driven by the motor.

The spur-rollers 5 are arranged to face the transporting rollers 4 respectively, sandwiching (pinching) the recording paper P which is transported between the spur-roller 5 and the transporting roller 4. Accordingly, when the transporting rollers 4 rotate, the spur-rollers 5 rotate, and the recording paper P sandwiched between the transporting roller 4 and the spur-roller 5 is transported in the paper feeding direction (downward direction in FIG. 1).

The head moving mechanism 6 is a mechanism for moving the line head 3 in the scanning direction, and includes a male screw portion 11, a female screw portion 12, and a drive motor 13. The male screw portion which is extended in the scanning direction has one end (an end on a left side in FIG. 1) thereof fixed to the line head 3, and the other end (an end on a right side in FIG. 1) thereof inserted through the female screw portion 12.

The female screw portion 12 is arranged on the right side of the male screw portion 11 in FIG. 1, and is fixed to the drive motor 13. When the drive motor 13 is driven, the female screw portion 12 rotates, and accordingly, the male screw portion 11 inserted through the female screw portion 12 moves in the scanning direction together with the line head 3.

The defective-nozzle detecting unit 7 is provided to each of the line heads 2 and 3, and includes a moving portion 21, a laser emitting portion 22, and a laser receiving potion 23. The moving portion 21 is a body in the form of a substantially rectangular plate, and is arranged facing a lower surface of the line heads 2 and 3. The moving portion 21 is capable of moving over an entire area of the line heads 2 and 3 in the scanning direction. The laser emitting portion 22 is arranged at one end portion (a right side in FIG. 2) in the paper feeding direction, of an upper surface of the moving portion 21, and emits laser rays toward a left side in the diagram. The laser receiving portion 23 is arranged at the other end portion (a left side in FIG. 2) in the paper feeding direction, of the upper surface of the moving portion 21, and receives the laser rays emitted from the laser emitting portion 22.

In the defective-nozzle detecting unit 7, the ink is jetted from the nozzles 10 while the moving portion 21 moved up to a position at which the laser light emitted from the laser emitting portion 22 faces each of the nozzles 10 of the line heads 2 and 3. At this time, when the ink has been jetted normally from the nozzles 10, the laser light emitted from the laser emitting portion 22 is shielded by the ink jetted, and no laser ray is received by the laser receiving portion 23. However, when there is a jetting-defect in the nozzles 10 such as a defect in a jetting direction of ink from the nozzles 10, or when the ink is not jetted from the nozzles 10, the laser ray emitted from the laser emitting portion 22 is not shielded by the ink, and a situation that the laser ray is received at the laser receiving portion 23 does not occur. Consequently, when the defective-nozzle detecting unit 7 is used, it is possible to detect whether or not there is a jetting-defect in the nozzles depending on whether or not the laser ray is received at the laser receiving portion 23.

Next, the control unit 50 which controls the operation of the printer 1 will be described below.

Figure 3:
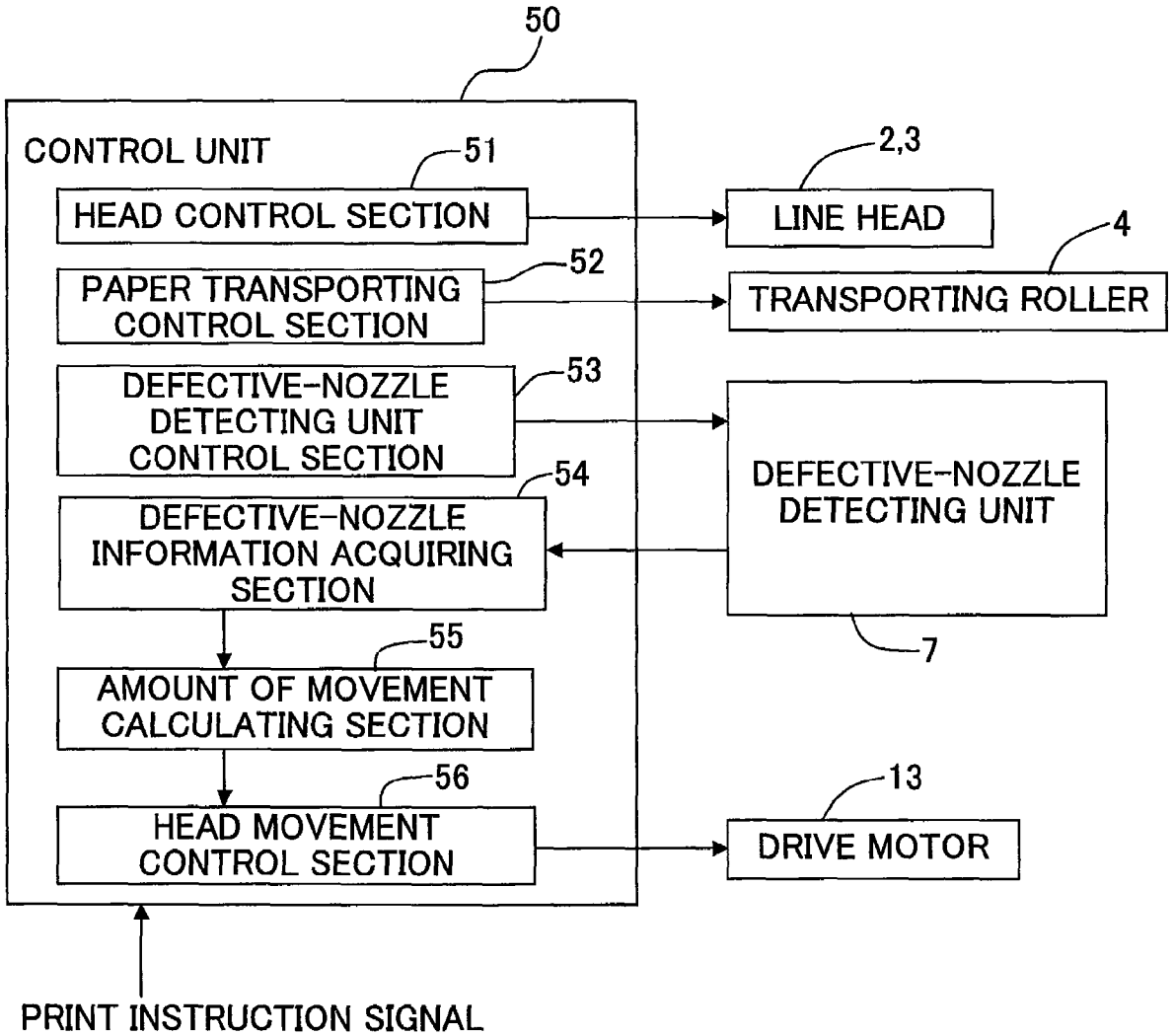
FIG. 3 is a functional block diagram of the control unit 50.
Figure 4:
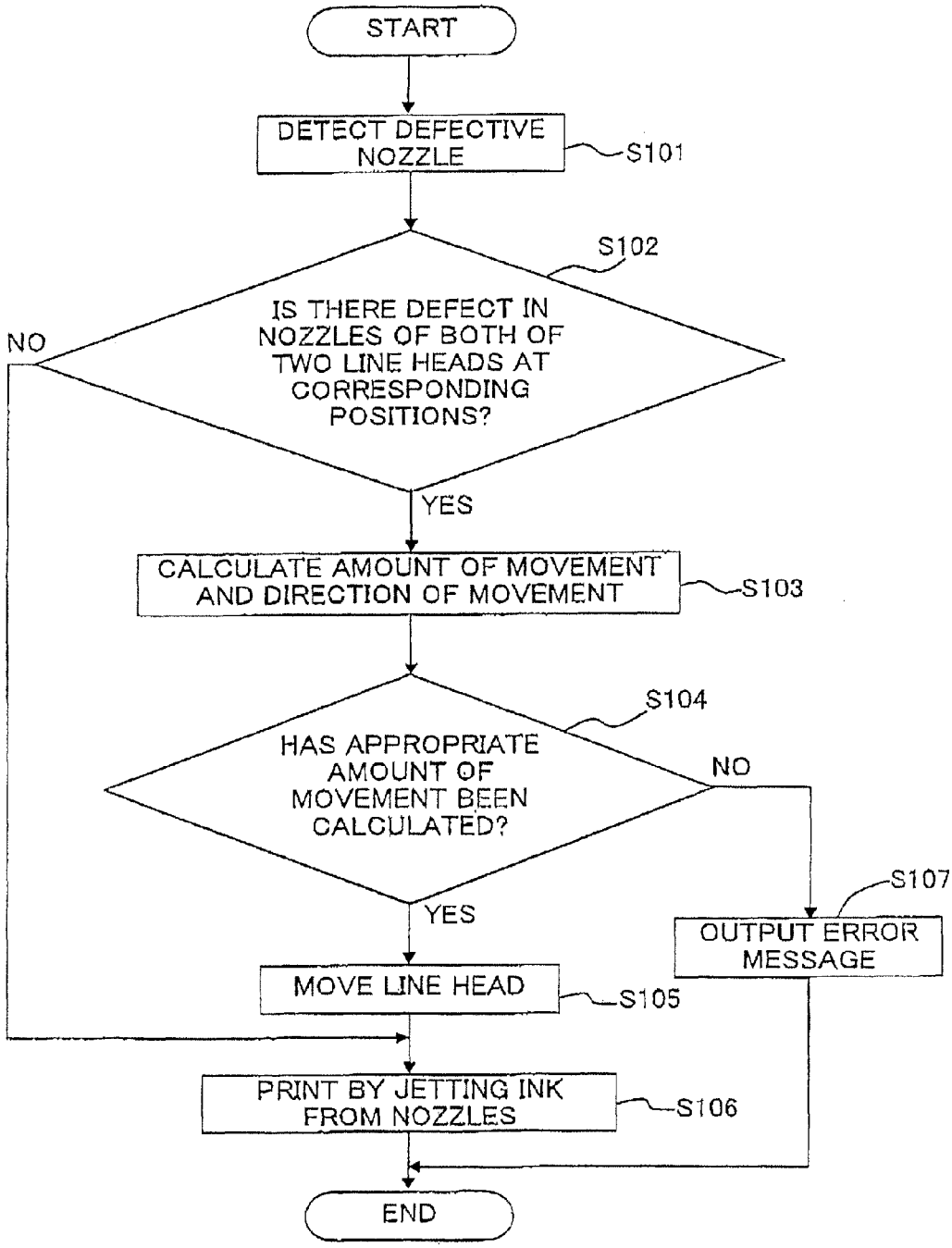
FIG. 4 is a flowchart showing the process of printing in the printer 1.

As shown in FIG. 3, the control unit 50 includes a head control section 51, a paper transporting control section 52, a defective-nozzle detecting unit control section 53, a defective-nozzle information acquiring section 54, an amount of movement (a movement-amount) calculating section 55, and a head movement control section 56. Moreover, a signal instructing printing (print instruction signal) from an external PC (personal computer) etc. is input to the control unit 50.

When the printer 1 performs printing, or performs detecting a defective nozzle, the head control section 51 carries out control of jetting of ink from the nozzles 10 in the line heads 2 and 3. The paper transporting control section 52 controls a movement of the transporting roller 4 such that the recording paper P is transported appropriately when the printer 1 performs printing.

The defective-nozzle detecting unit control section 53, at the time of carrying out detection of a defective nozzle, controls an operation of the defecting-nozzle detecting unit 7 such as a movement of the moving portion 21 and an emission of the laser light from the laser emitting portion 22. In the first embodiment, a combination of the defective-nozzle detecting unit 7 and the defective-nozzle detecting unit control section 53 which controls the defective nozzle defecting unit 7 corresponds to a defective-nozzle detecting mechanism according to the present invention.

The defective-nozzle information acquiring section 54 acquires information indicating as to which nozzle 10 is defective (defective-nozzle information), based on a detection result of the defective-nozzle detecting unit 7. The amount of movement calculating section 55 calculates a movement amount of the line head 3 from the defective-nozzle information acquired by the defective-nozzle information acquiring section 54. Here, the amount of movement calculated by the amount of movement calculating section 55 means a combination of a magnitude of the amount of movement of the line head 3, and a direction of movement of the line head 3.

The head movement control section 56 controls an operation of the drive motor 13 at the time of moving the line head 3 in the scanning direction. In the first embodiment, a combination of the head moving mechanism 6, the amount of movement calculating section 55, and the head movement control section 56 corresponds to a head moving mechanism according to the present invention.

Next, a process of printing carried out on the recording paper P by the printer 1 will be described below. An operation as described below is started when the print instruction signal is input to the printer 1 from an external PC etc.

When the print instruction signal is input, firstly, a detection of a defective nozzle of the line heads 2 and 3 is carried out (step S101). Concretely, the defective-nozzle detecting unit control section 53 controls the defective-nozzle detecting unit 7 such that the moving portion 21 moves up to a position at which the laser light emitted from the laser emitting potion 22 faces the nozzles 10, and that the ink is jetted from the nozzles 10 in this state. Moreover, when the laser light is not received any more at the laser receiving portion 23, a judgment is made that there is no defect in the nozzles 10. When the laser light is received at the laser receiving portion 23, a judgment is made that there is a defect in the nozzles 10.

When there is no defect in the nozzles 10 at the same position in the scanning direction, of both of the line heads 2 and 3, or when there is a defect in the nozzle 10 at the same position in the scanning direction, of one of the line heads 2 and 3 (NO at step S102), in this state, printing is carried out on the recording paper P by jetting ink from the nozzles 10 of the line heads 2 and 3.

Here, in the printer 1, since the nozzles 10 of the line head 2 and the nozzles 10 of the line head 3 are arranged to overlap mutually when viewed from the paper feeding direction, the ink may be jetted from the nozzles 10 of one of the line heads 2 and 3 at each point (at all points) of the recording paper P, on which the ink is to be made to land. Consequently, for example, as shown in FIG. 5, when the line heads 2 and 3 are controlled such that the ink jetted from the nozzles 10 of the line head 2 and the ink jetted from the nozzles 10 of the line head 3 are arranged to be lined up alternately in the paper feeding direction and the scanning direction, it is possible to carry out printing at a high speed as compared to a case of carrying out printing by using one of the line heads 2 and 3.

Moreover, when there is a defective nozzle in the nozzles 10 of only one of the line heads 2 and 3 at the same position in the scanning direction, the ink is not jetted from the defective nozzle of the one of the line heads 2 and 3. Further, an amount of jetting of ink from the nozzles 10 of the other line head, at the same position as the defective nozzle in the scanning direction is increased as compared with an amount of ink in a case in which there is no defective nozzle in the nozzles 10.

Figure 5:
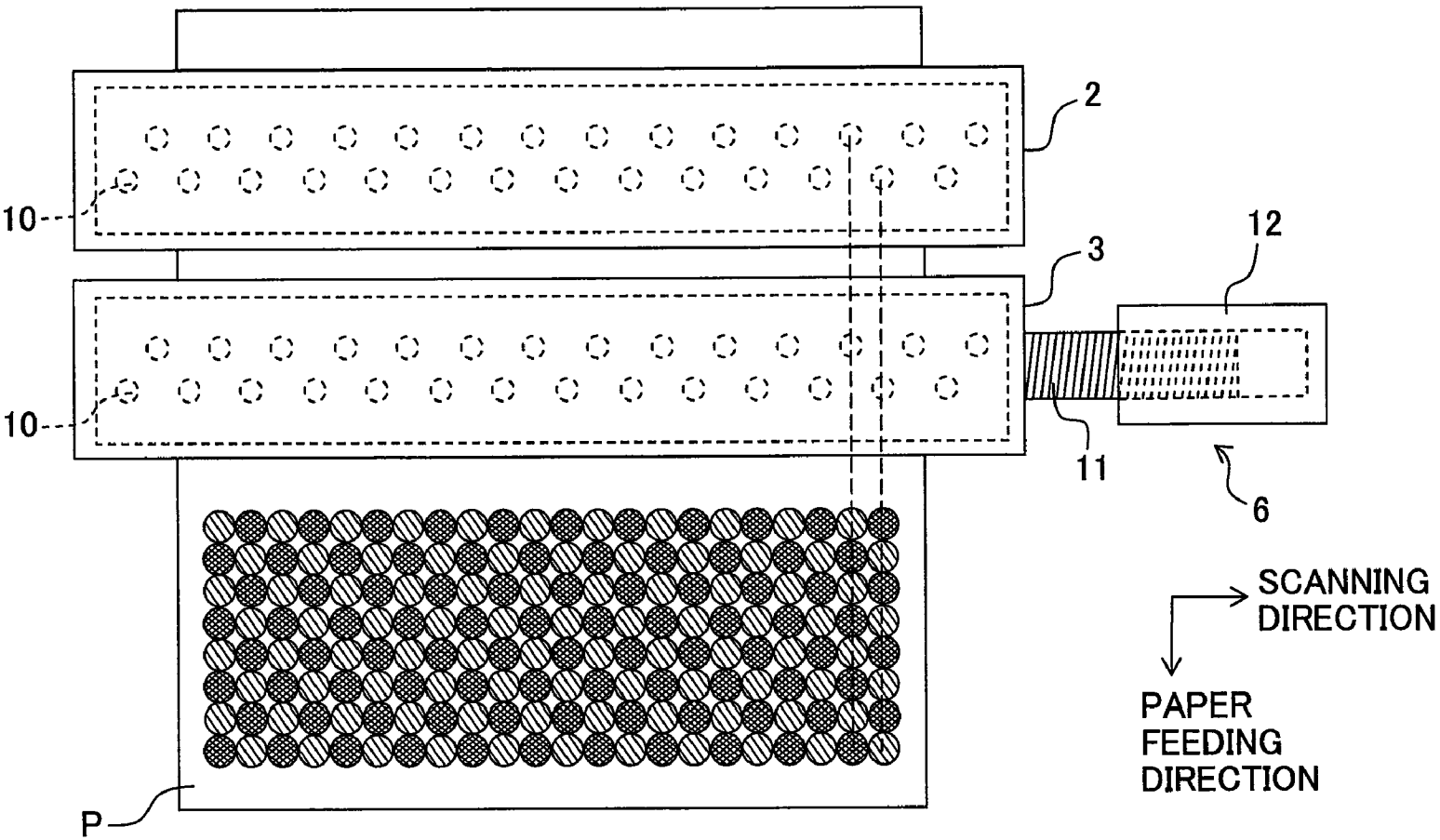
FIG. 5 shows the positions of the two line heads and the printed image when the two line heads have no defective nozzle.
Figure 6:
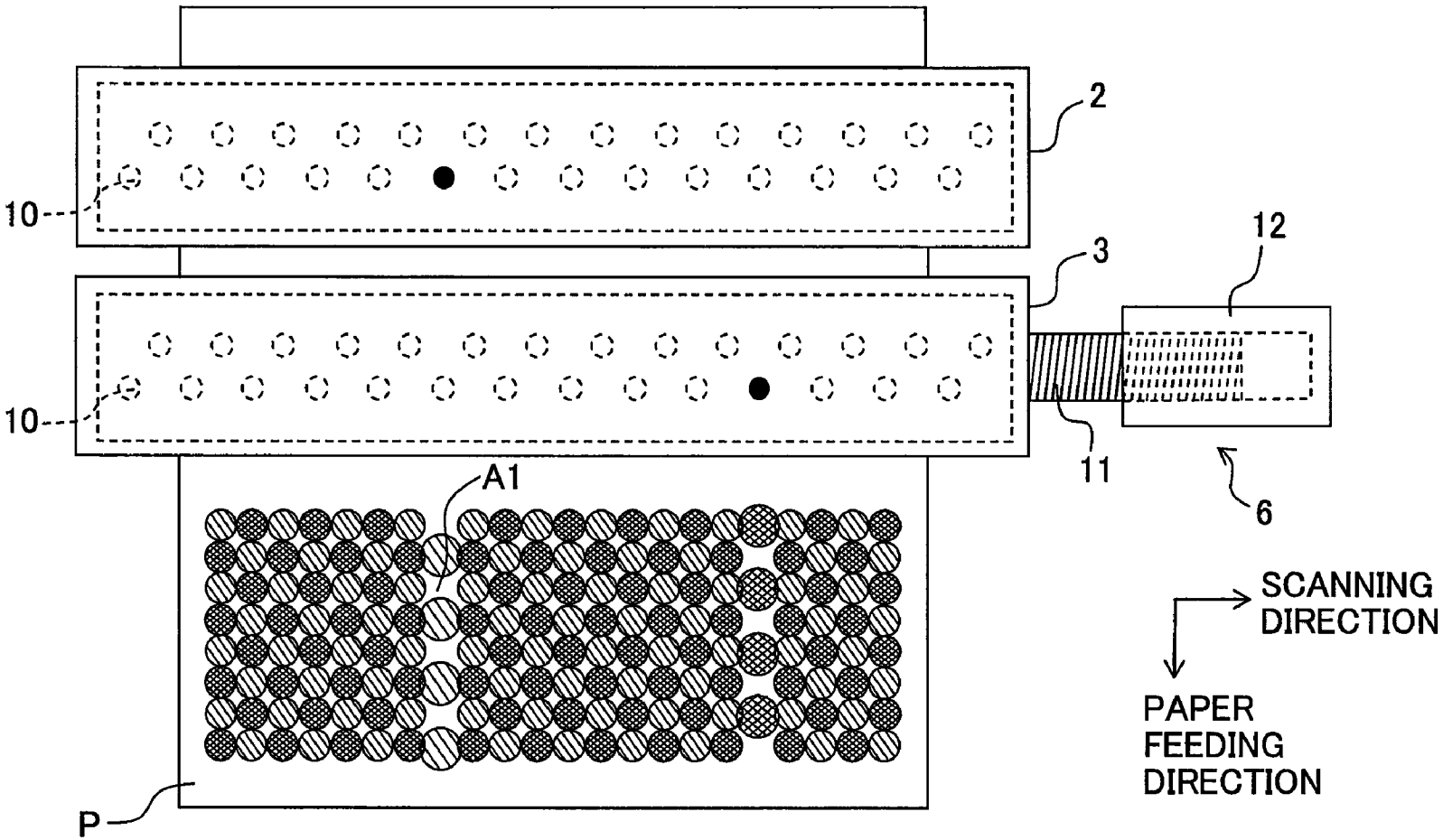
FIG. 6 shows a diagram corresponding to FIG. 5 when one of the two line heads has defective nozzles.
Figure 7:
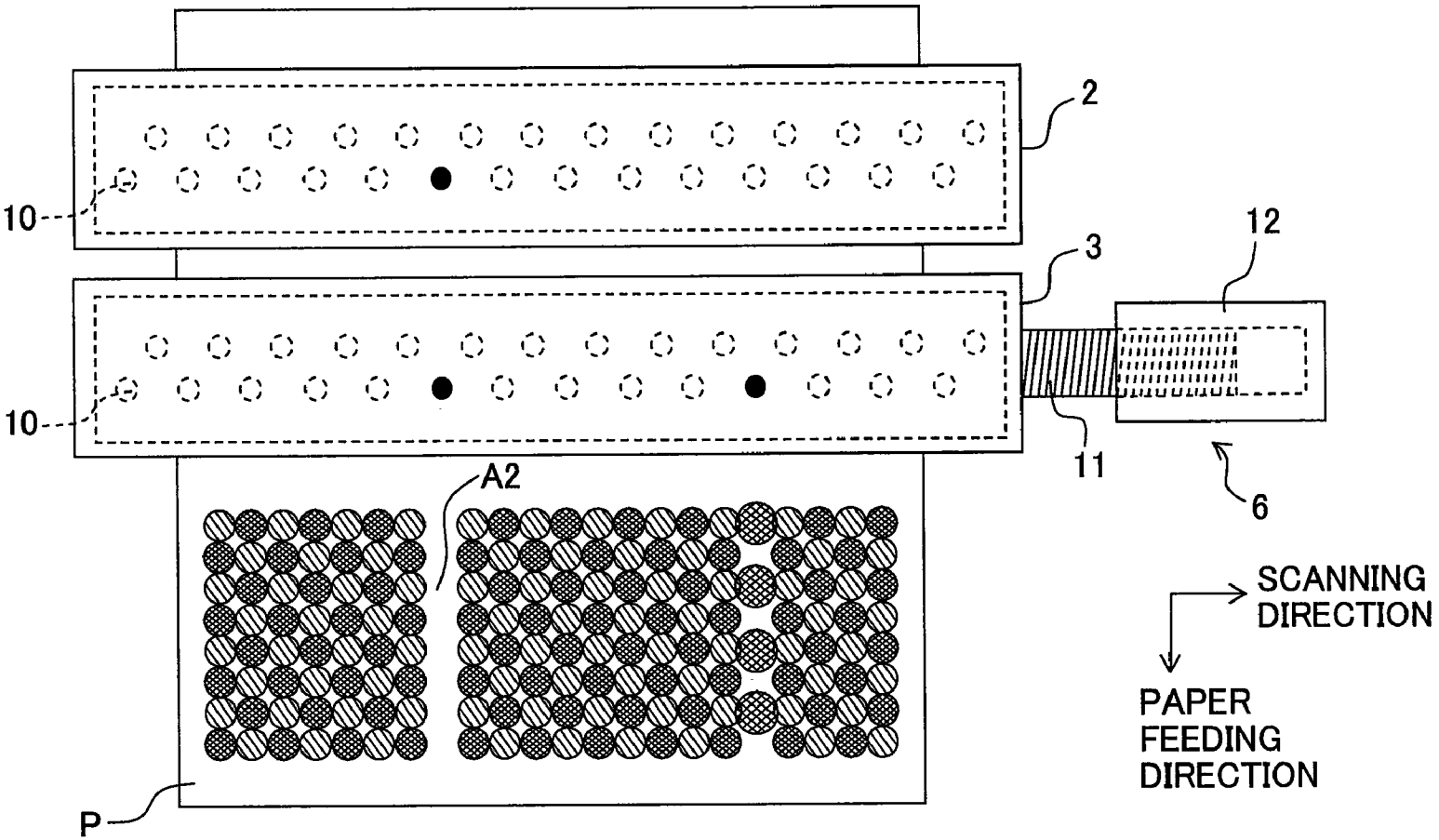
FIG. 7 shows a diagram corresponding to FIG. 5 when the defective nozzles of the two line heads are at the same position but the two line heads are not moved.

Accordingly, when there is no defect in any of the nozzles 10 of the line heads 2 and 3, the ink lands on the recording paper P without any gap as shown in FIG. 5. Moreover, for instance, when there is a jetting-defect only in the nozzle 10 of the line head 2, ink is not jetted from the defective nozzle, on an area A1 on the recording paper P, and there is a portion on which the ink is not landed. However, an area of ink which is jetted from the nozzle 10 to land on the area A1 increases by an amount increased of jetting of ink from the nozzle 10, the jetted nozzle 10 of the line head 3 being at the same position in the main scanning direction as the defective nozzle 10 of the line head 2. Therefore, an area of a portion on which the ink does not land on the area A1 becomes small, and a degradation of a printing quality is suppressed. In FIG. 6, the nozzles 10 painted in black are defective nozzles 10, and same is the case in FIGS. 7, 8, and 9 which will be described later.

On the other hand, when there is a defect in the nozzles 10 at the same position in the scanning direction of both the line heads 2 and 3 (YES at step S102), in the amount of movement calculating section 55, an amount of movement of the line head 3 is calculated from the defective-nozzle information acquired by the defective-nozzle information acquiring section 54 (step S103).

Moreover, when an appropriate amount of movement is calculated at step S103 (YES at step S104), the printing is carried out on the recording paper P (step S106) by jetting the ink from the nozzles 10 of the line heads 2 and 3 after moving the line head 3 by driving the drive motor 13 only by an amount of movement calculated (step S105), and thereafter the operation is terminated. Whereas, when the appropriate amount of movement is not calculated at step S103 (NO at step S104), the operation is terminated after outputting an error message (step S107).

Here, an operation at steps from step S103 to step S107 will be described below in detail. Assuming that although there is a defect in the nozzles 10 at the corresponding positions of both the line heads 2 and 3, the process advances to step S106 without carrying out the operation at steps from step S103 to step S105. In this case, when the printing is carried out by jetting the ink from the nozzles 10 of the line heads 2 and 3, an area A2 having lines (stripes) extended in the paper feeding direction on which the ink is not landed is developed on a portion of the recording paper P at which the ink jetted from the defective nozzle 10 is supposed to land. Moreover, in an image which is printed, such area A2 having lines becomes conspicuous, and accordingly, the printing quality is degraded.

Therefore, in the first embodiment, by carrying out the operation at the steps from the step S103 to step S105, the line head 3 is moved such that the defective nozzles 10 of the line head 2 and the defective nozzles 10 of the line head 3 are not at the same position in the scanning direction.

Figure 8:
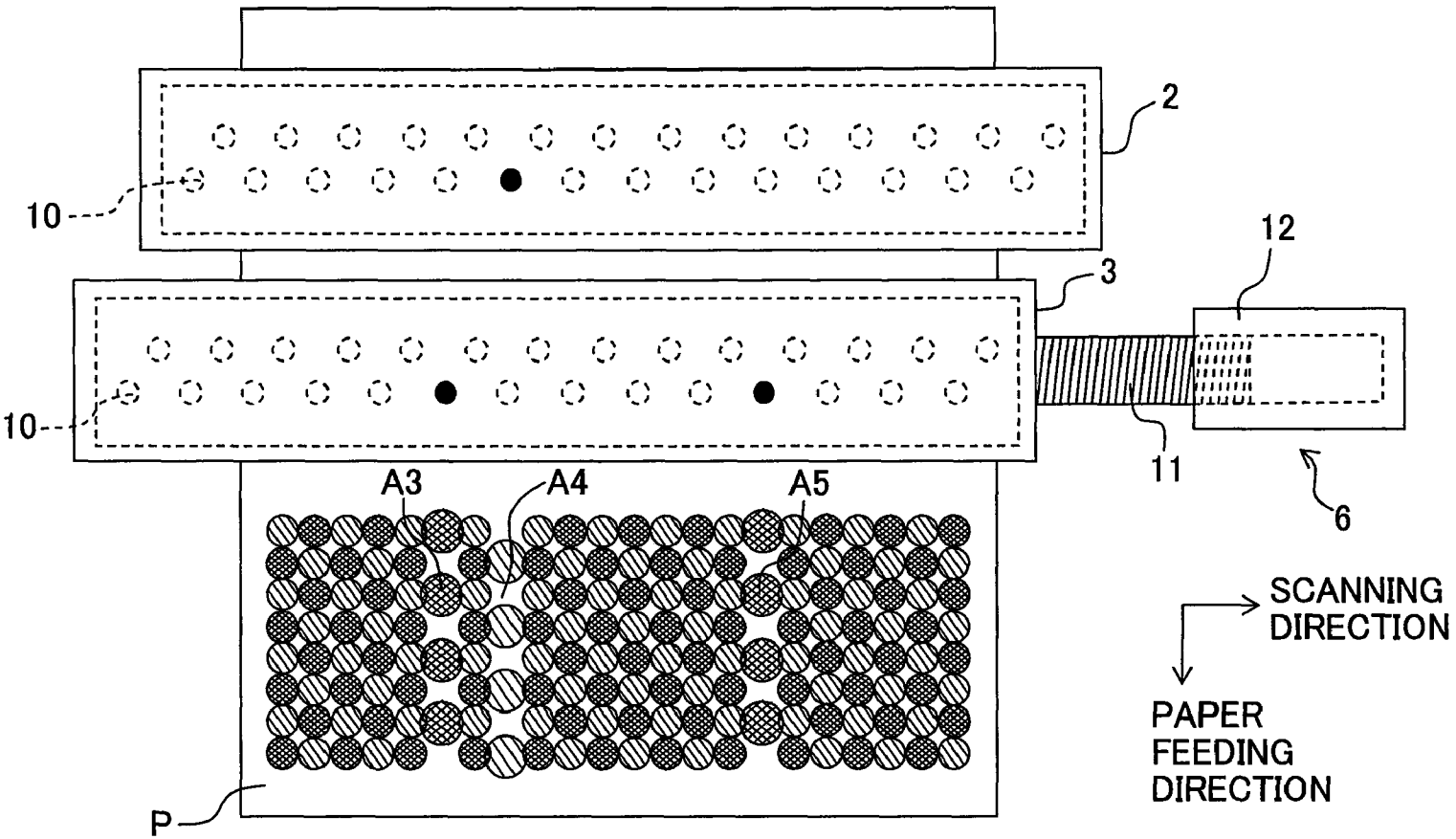
FIG. 8 shows a diagram corresponding to FIG. 5 when the defective nozzles of the two line heads are at the same position but the two line heads are moved such that the defective nozzles are shifted by twice a nozzle gap.

Furthermore, at step S103, if possible, the amount of movement of the line head 3 is calculated such that when the line head 3 is moved, the defective nozzles 10 of the line head 2 and the defective nozzles 10 of the line head 3 are separated by not less than twice a nozzle interval D in the scanning direction, as shown in FIG. 8. Then, the line head 3 is moved only by the amount which is calculated.

Accordingly, an area on which the ink jetted from the nozzles 10 of both the line heads 2 and 3 is developed between areas from an area A3 to an area A5 on which the ink jetted from the nozzles 10 of only one of the line heads 2 and 3 has landed. Therefore, in an image which is printed, the areas from the area A3 to the area A5 become hardly visible, and the degradation of the printing quality is suppressed.

Figure 9:
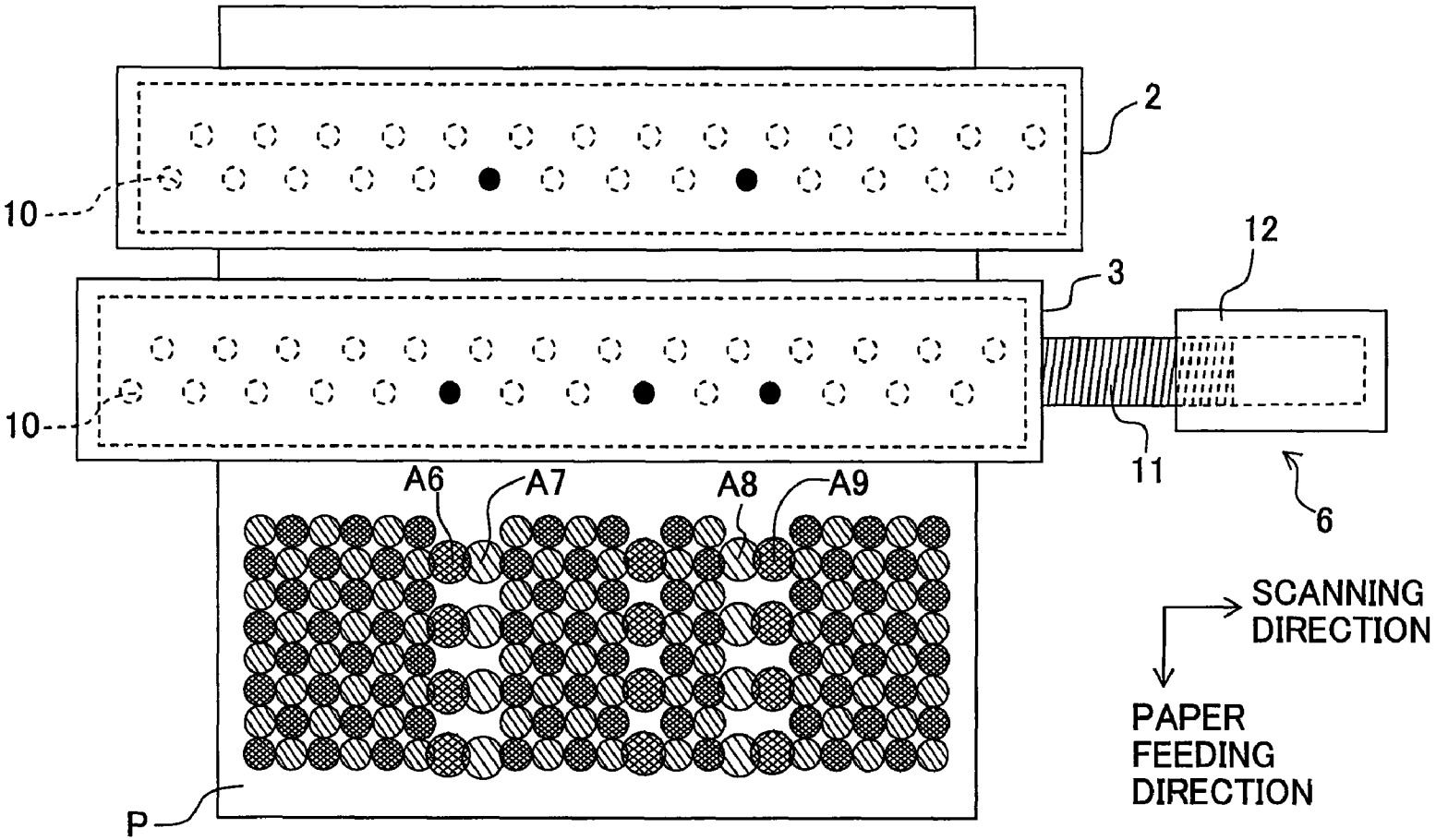
FIG. 9 shows a diagram corresponding to FIG. 5 when the defective nozzles of the two line heads are at the same position but the two line heads are moved such that the defective nozzles are shifted by one nozzle gap.

Whereas, assuming that although the line head 3 is moved to any position, it is impossible to separate away the defective nozzle 10 of the line head 2 and the defective nozzle 10 of the line head 3 by not less than double the nozzle interval D in the scanning direction. In this case, at step S103, for instance, the amount of movement of the line head 3 is calculated such that the defective nozzle 10 of the line head 2 and the defective nozzle 3 of the line head 3 are separated by only the nozzle interval D in the scanning direction as shown in FIG. 9, and the line head 3 is moved only by the amount of movement which is calculated. In this case, an area on which only the ink jetted from the nozzles 10 of the line head 2 and an area on which only the ink jetted from the nozzles 10 of the line head 3 (an area A6 and an area A7, and an area A8 and an area A9 in FIG. 9) are arranged to be adjacent in the scanning direction, and in a printed image, a degradation of the printing quality in a portion of the areas A6 to A9 is somewhat visible. However, since the lined (striped) area A2 of the recording paper P, on which the ink is not jetted is not developed (refer to FIG. 7), the printing quality is suppressed from being degraded substantially.

Here, there might be a plurality of positions of the line heads at which the nozzles 10 of the line heads 2 and 3 fulfill the abovementioned positional relationship, and at step S103, the amount of movement of the line head 3 is calculated such that the magnitude of the amount of movement of the line head 3 becomes minimum. Accordingly, it is possible to make the amount of movement of the line head 3 as small as possible. Moreover, only when the defective nozzle 10 of the line head 2 and the defective nozzle 10 of the line head 3 are at the same position in the scanning direction (YES at step S102), the line head 3 is moved. Therefore, it is possible to move the line head 3 only when it is necessary.

A judgment that an appropriate amount of movement has been calculated at step S104 is made (YES at step S104) when it is possible to calculate the amount of movement of the line head 3 such that the defective nozzle 10 of the line head 2 and the defective nozzle 10 of the line head 3 come to mutually different positions in the scanning direction as shown in FIGS. 8 and 9, at step S103. Whereas, a judgment that an appropriate amount of movement has not been calculated is made (NO at step S104) when the defective nozzle 10 of the line head 2 and the defective nozzle 10 of the line head 10 come to the same position in the scanning direction.

According to the first embodiment described above, the line head 3 can be moved such that the defective nozzle 10 of the line head 2 and the defective nozzle 10 of the line head 3 do not overlap in the scanning direction, when the printing is performed in the printer 1. In this case, the printing quality is suppressed from being degraded, since the lined area A2 extended in the paper feeding direction on which the ink does not land, is not developed on the recording paper P.

Furthermore, if possible, the line head 3 is moved such that the defective nozzle 10 of the line head 2 and the defective nozzle 10 of the line head 3 are separated away by not less than double the nozzle interval D in the scanning direction. Therefore, areas on which only the ink jetted from the nozzles 10 of one of the line heads 2 and 3 lands are not adjacent in the scanning direction. Consequently, this area is hardly visible in a printed image, and the printing quality is suppressed from being degraded.

Moreover, when it is not possible to separate away the defective nozzle 10 of the line head 2 and the defective nozzle 10 of the line head 3 by not less than double the nozzle interval D in the scanning direction even by moving the line head 3 to any position, the line head 3 is moved such that the defective nozzle 10 of the line head 2 and the defective nozzle 10 of the line head 3 are separated away by the nozzle interval D in the scanning direction. Therefore, an area on which only the ink jetted from the nozzles 10 of the line head 2 lands, and an area on which only the ink jetted from the nozzles 10 of the line head 3 lands are adjacent in the scanning direction, and a degradation of the printing quality at this portion in a printed image is somewhat visible. However, since the lined area A2 is not developed, the printing quality is suppressed from being degraded substantially.

Moreover, the line head 2 is fixed to the printer 1, and the line head 2 and the line head 3 are moved relatively in the scanning direction by moving the line head 3 in the scanning direction. Therefore, the head moving mechanism 6 may be provided only to the line head 3, thereby making a structure of the printer 1 simple.

Next, modified embodiments in which various modifications are made in the first embodiment will be described below. However, same reference numerals are assigned to components having a structure similar as in the first embodiment, and description of such components is omitted.

In the first embodiment, when it is not possible to separate away the defective nozzle 10 of the line head 2 and the defective nozzle 10 of the line head 3 by not less than double the nozzle interval D in the scanning direction, even by moving the line head 3 to any position, the line head 3 is moved such that the defective nozzle 10 of the line head 2 and the defective nozzle 10 of the line head 3 are arranged to be separated away by the nozzle interval D in the scanning direction. However, without restricting to such an arrangement, an arrangement may be made such that when it is not possible to separate away the defective nozzle 10 of the line head 2 and the defective nozzle 10 of the line head 3 by not less than double the nozzle interval D in the scanning direction even by moving the line head 3 to any position, an error message saying that "an appropriate amount of movement could not be calculated" can be displayed.

First Modified Embodiment

Moreover, in the first embodiment, if possible, the line head 3 is moved such that the defective nozzle 10 of the line head 2 and the defective nozzle 10 of the line head 3 are separated away by not less than double the nozzle interval D in the scanning direction. However, the present invention is not restricted to such an arrangement. In a first modified embodiment, when there is a defect in nozzles 10 of both the line heads 2 and 3 which are at the same position in the scanning direction as shown in FIG. 5, the line head 3 is moved such that the defective nozzle 10 of the line head 2 and the defective nozzle 10 of the line head 3 are separated away by only the nozzle interval D in the scanning direction as shown in FIG. 10.

Figure 10:
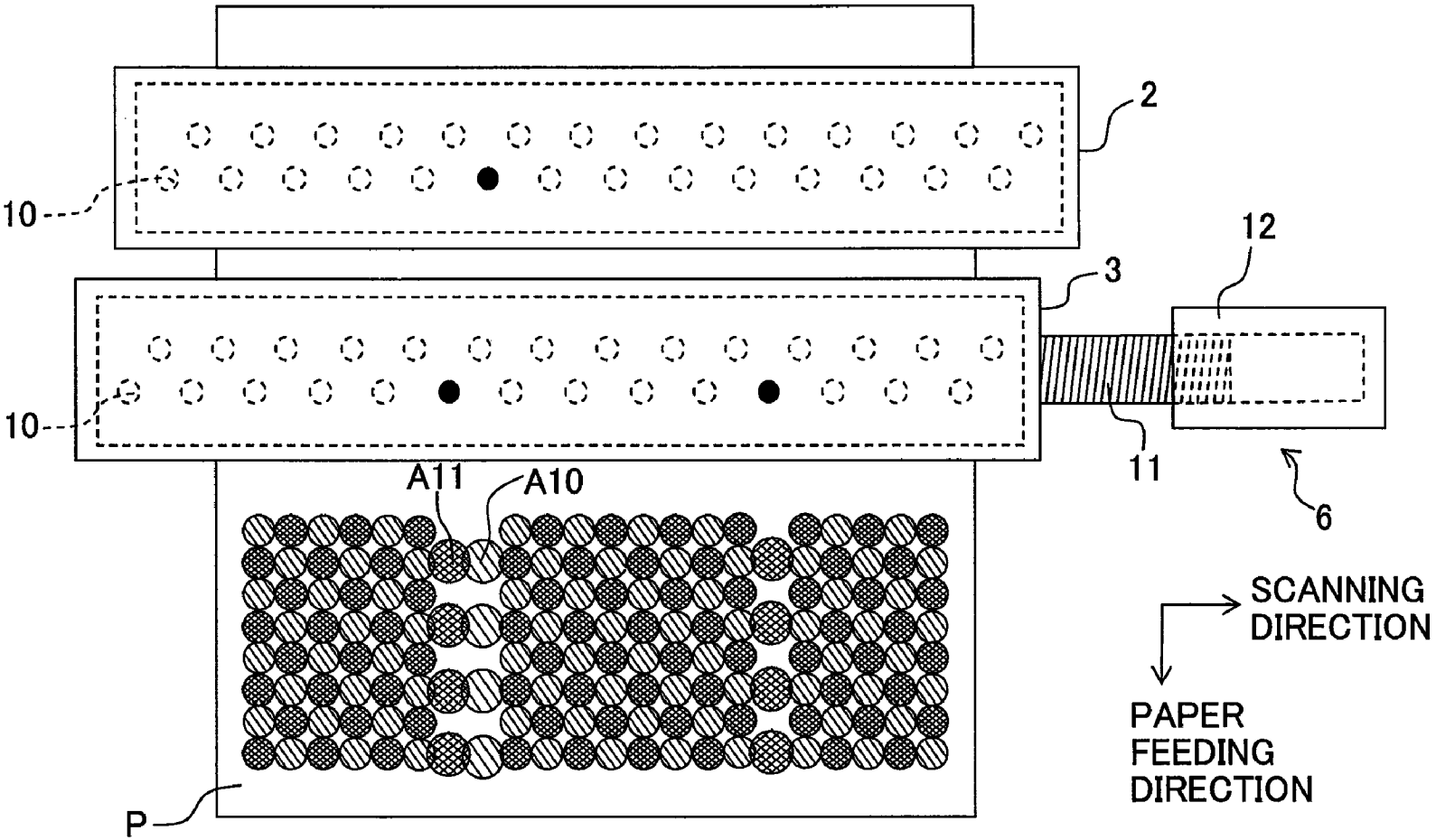
FIG. 10 shows a diagram of the first modified embodiment corresponding to FIG. 5.

In this case, an area A10 on which only the ink jetted from the nozzles 10 of the line head 2 lands, and an area A11 on which only the ink jetted from the nozzles 10 of the line head 3 lands are adjacent in the scanning direction as shown in FIG. 10, and a degradation of an image quality in this portion of an image which is printed is somewhat visible. However, since the lined area A2 on which the ink does not land is not developed on the recording paper P (refer to FIG. 7), a substantial degradation of a quality of printing of a printed image is suppressed. Moreover, in this case, an amount of movement of the line head 3 smaller than in the case of the first embodiment serves the purpose.

Second Modified Embodiment

Figure 11:
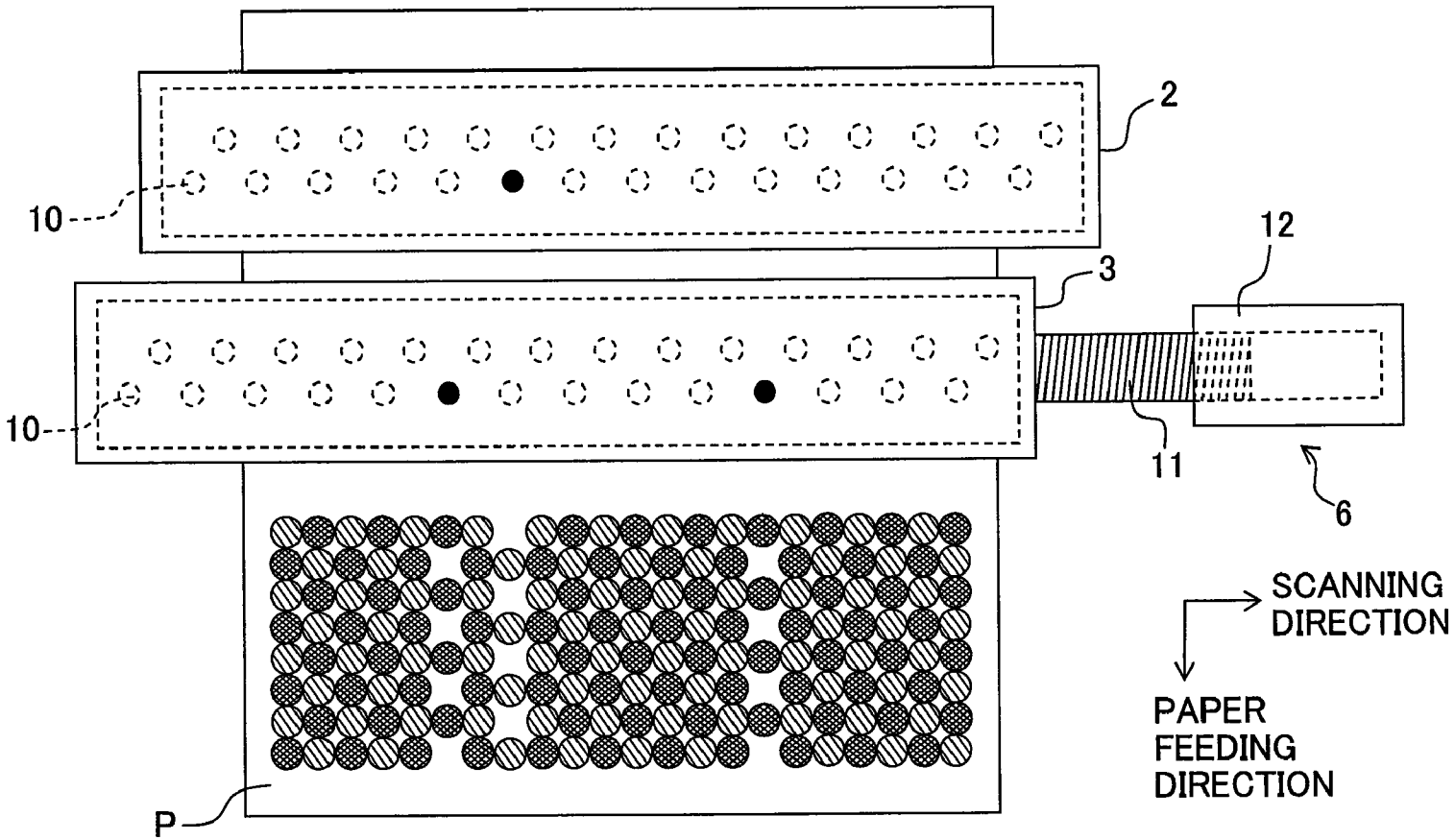
FIG. 11 shows a diagram of the second modified embodiment corresponding to FIG. 5.

In the first embodiment, when one of the two nozzles 10 of the line heads 2 and 3 respectively, positioned at the same position in the scanning direction has a defect, and when the ink is jetted only from the other nozzle 10 without defect, the amount of ink to be jetted from the other nozzle 10 is increased. However, the present invention is not restricted to such an arrangement. In a second modified embodiment, as shown in FIG. 11, when one of the two nozzles 10 of the line heads 2 and 3 respectively, positioned at the same position in the scanning direction has a defect, and when the ink is jetted only from the other nozzle 10 without defect, an amount of ink to be jetted from the other nozzle 10 is let to be the same as in a case in which no defect occurs in the one of the two nozzles 10.

Even in this case, when both the nozzles 10 of the line heads 2 and 3, at the same position in the scanning direction have a defect, (even) by moving the line head 3 such that these nozzles 10 assume mutually different positions in the scanning direction, the lined area A2 on which the ink is not jetted from the nozzles 10 of any of the line heads 2 and 3 (refer to FIG. 7) is not developed on the recording paper P. Therefore, the degradation of the image quality is suppressed.

Moreover, in the first embodiment, the line head 3 is moved such that the amount of movement becomes the minimum. However, the amount of movement calculated at (by) the amount of movement calculating section 55 may not be of a minimum amount.

Moreover, in the first embodiment, the defective-nozzle detecting unit 7 is provided to the printer 1, and the defective-nozzle information acquiring section 54 acquires the defective-nozzle information from the detection result of the defective-nozzle detecting unit 7. However, the present invention is not restricted to such an arrangement. For example, the defective-nozzle detecting unit 7 may not be provided to the printer, and arrangement may be made such that a nozzle 10 having a defect is detected by checking the line heads 2 and 3 at the time of manufacturing, and the defective-nozzle information acquiring section 54 acquires the defective-nozzle information from a result of the check carried out at the time of manufacturing. Moreover, at the time of carrying out printing, the amount of movement calculating section 55 may determine the amount of movement of the line head 3 from the defective-nozzle information which is acquired by the defective-nozzle information acquiring section 54, and the head movement control section 56 may move the line head 3 only by the amount of movement determined by the head movement control section 56.

Furthermore, in the first embodiment, the defective-nozzle information acquiring section 54 and the amount of movement calculating section 55 are provided to the control unit 50 (refer to FIG. 3), and the amount of movement of the line head 3 is calculated by the amount of movement calculating section 55 of the control unit 50. However, the present invention is not restricted to such an arrangement.

Third Modified Embodiment

Figure 12:
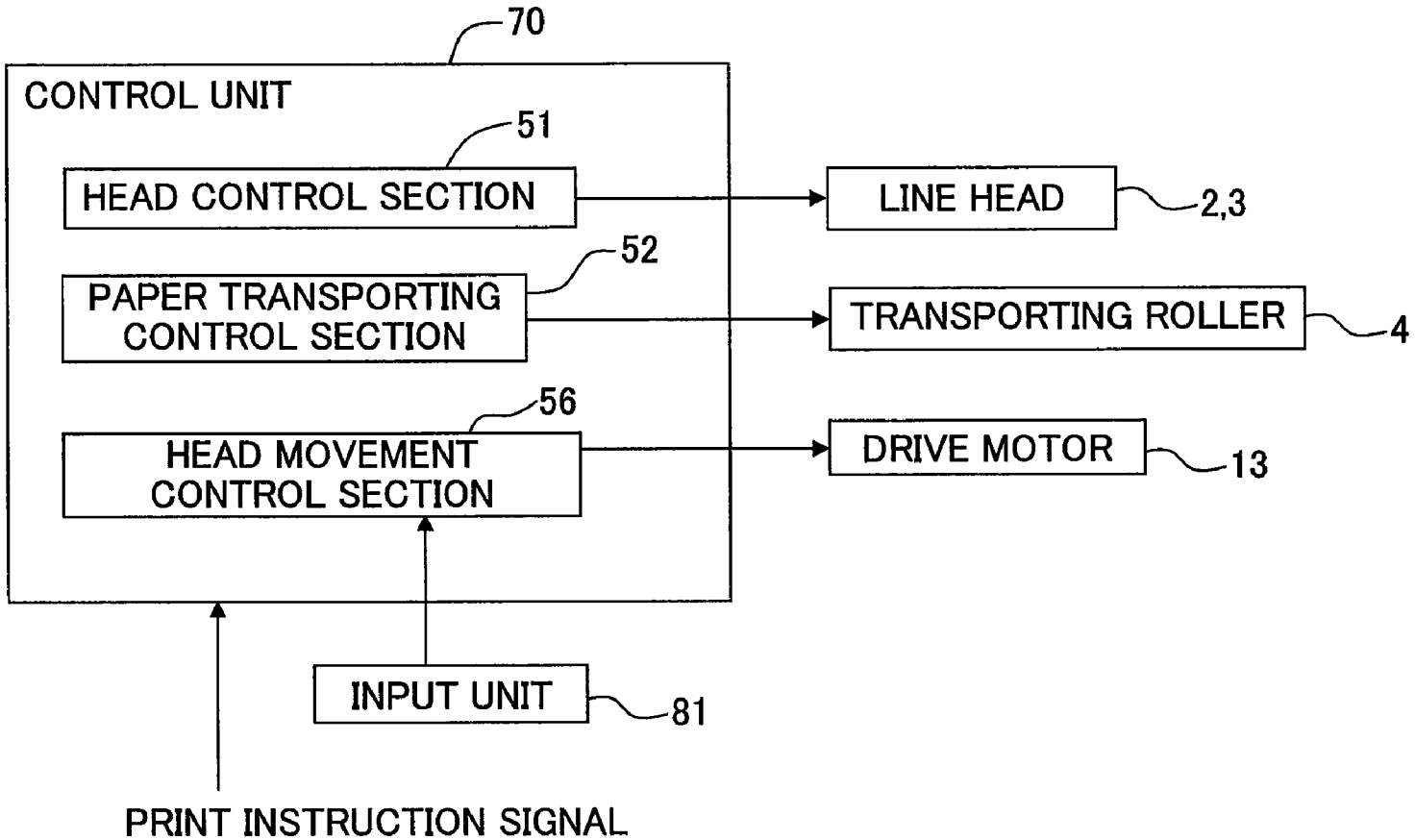
FIG. 12 shows a diagram of the third modified embodiment corresponding to FIG. 3.

In a third modified embodiment, the defective-nozzle detecting unit 7 (refer to FIG. 2) is not provided to the printer. Moreover, as shown in FIG. 12, the defective-nozzle detecting unit control section 53, the defective-nozzle information acquiring section 54, and the amount of movement calculating section 55 (refer to FIG. 3) are not provided to a control unit 70. Furthermore, the printer is provided with an input unit (an input device) 81 for a user of the printer to input to the control unit 70 a test-pattern formation instruction signal and the number of a test pattern which is selected. Here, the input unit 81 is a button etc. provided to the printer.

Figure 13:
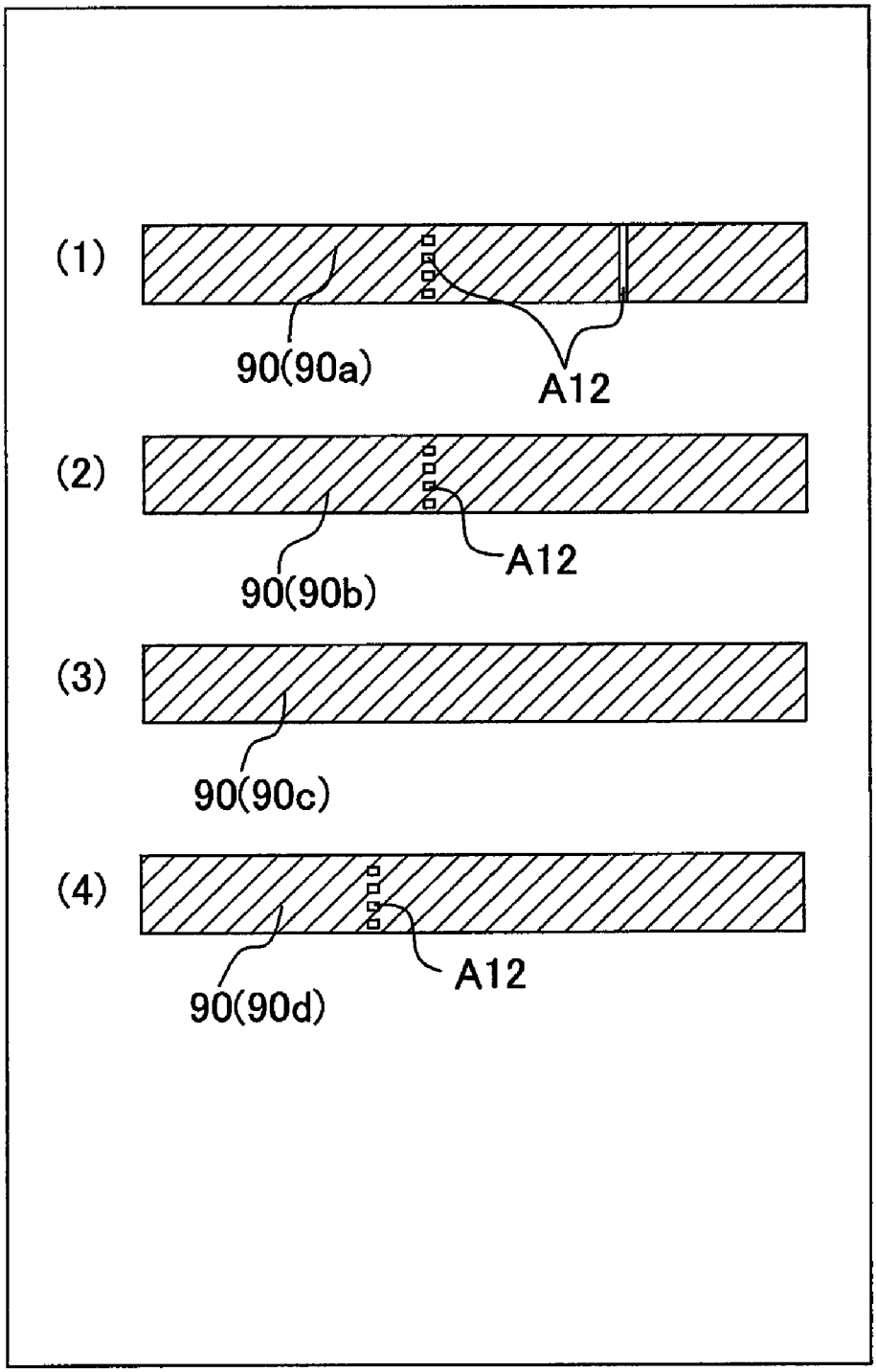
FIG. 13 shows a diagram of the test patterns printed in the third modified embodiment.

Here, the test-pattern formation instruction signal is a signal which gives an instruction for printing the test pattern (for executing a test-pattern formation mode) as described below. When the user inputs the test-pattern formation instruction signal to the control unit 70 by operating the input unit 81, the line head 3, upon being controlled by the head movement control section 56, moves to a plurality of mutually different positions (plurality of relatively mutually different positions of the two line heads 2 and 3). With the line head 3 at various positions, a plurality of test patterns 90 (four test patterns 90 from (1) to (4) in FIG. 13) are printed on a recording paper P which is transported by the transporting roller 4 and the spur-roller 5 by jetting the ink from the nozzles 10 of the line head 2 and 3.

The user checks these test patterns 90 visually, and selects one test pattern 90 considered to have the best printing quality from among these test patterns 90. Then, the user inputs the number of the selected test pattern 90 by operating the input unit 81. At this time, the user selects the test pattern 90 not including an area A12 on which the ink does not land, as the test pattern 90 considered to have the best printing quality. When such test pattern 90 is not included in the test patterns, the user selects the test pattern 90 including the smallest area A12, and further, when there is a plurality of areas A12, the plurality of areas 12 are arranged to be as much scattered as possible (For example, the user selects the test pattern 90 having the number (3) in FIG. 13).

When a signal of the selected test pattern 90 is input, the head movement control section 56 moves the line head 3 to a position at the time when the test pattern 90 corresponding to the signal input is printed. Moreover, the printing is carried out on the recording paper P by jetting the ink from the nozzles 10 of the line heads 2 and 3 in this state.

In this case, since the user selects the appropriate test pattern 90 from among the plurality of test patterns 90, the defective nozzles 10 of the line heads 2 and 3 are hardly arranged at same positions in the scanning direction, and the degradation of the image quality which is printed is suppressed.

Moreover, in the third modified embodiment, the input unit 81 is provided to the printer. However, the present invention is not restricted to such an arrangement. An arrangement may be made such that the test-pattern formation instruction signal and the number of the test pattern selected are input to the control unit 70 from an external PC etc.

Fourth Modified Embodiment

Figure 14:
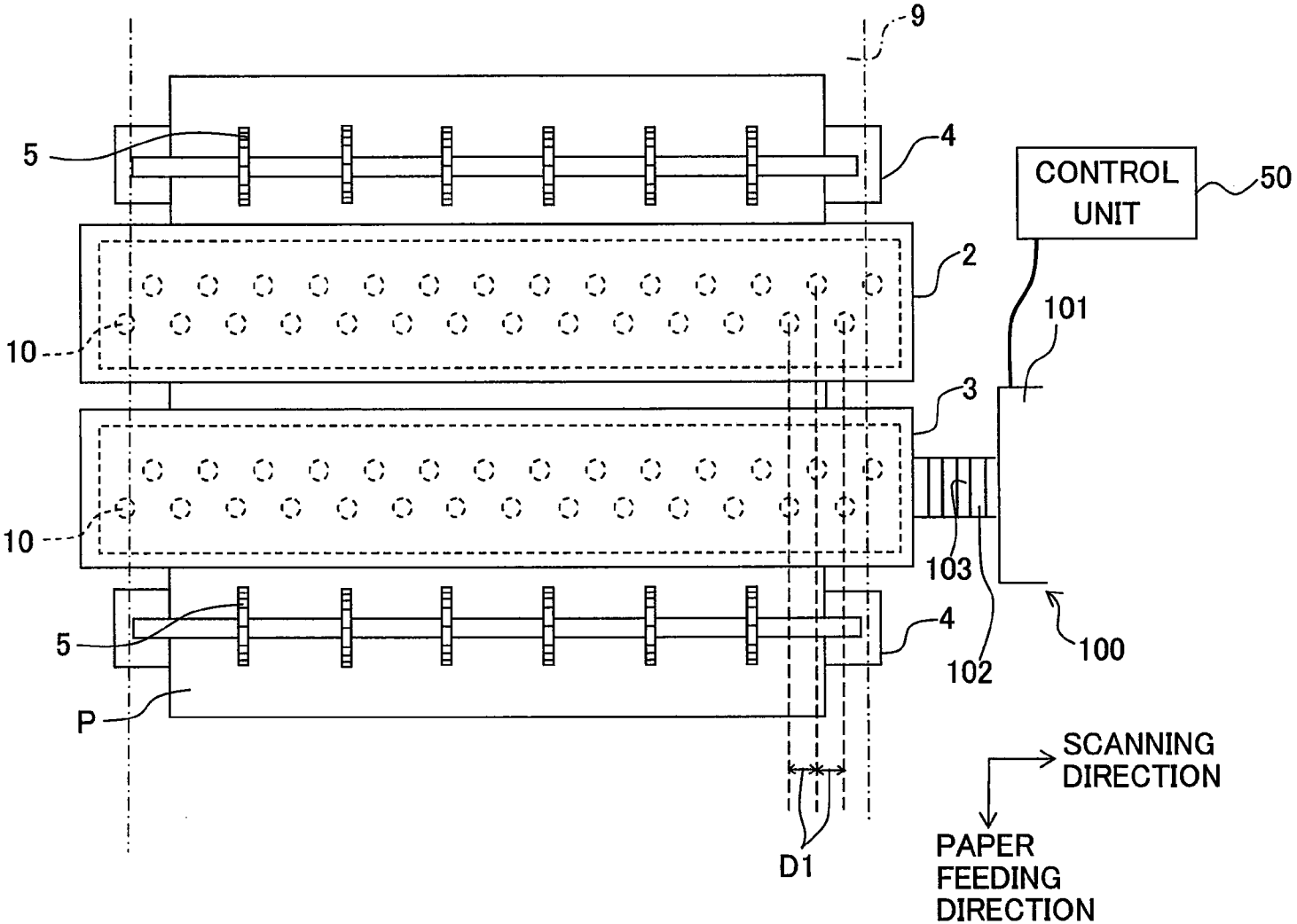
FIG. 14 shows a diagram of the fourth modified embodiment corresponding to FIG. 1.

Moreover, the head moving mechanism is not restricted to a mechanism which includes the male screw portion 11, the female screw portion 12, and the drive motor 13. In a fourth modified embodiment, a head moving mechanism 100, as shown in FIG. 14, includes a fixed base (fixed stage) 101, and a plurality of piezoelectric layers 102 and a plurality of electrodes 103. The fixed base 101 is arranged facing a side surface of a right side in the diagram, of the line head 3, and is fixed to the printer. The piezoelectric layers 102 are arranged to be stacked in the scanning direction, between the side surface of the right side in the diagram of the line head 3 and the fixed base 101, and is polarized in the scanning direction. The electrodes 103 are arranged on each surface of the piezoelectric layers 102, sandwiching the piezoelectric layers 102.

In this case, when an electric potential difference is generated between the two electrodes 103 sandwiching each piezoelectric layer 102 by changing an electric potential of the electrodes 103, an electric field in the scanning direction is generated in each piezoelectric layer 102. Since a direction of the electric field coincides with a direction of polarization of the piezoelectric layer 102, the piezoelectric layers 102 are elongated in the scanning direction. Accordingly, the line head 3 moves to left side in the diagram, in the scanning direction. Whereas, when the two electrodes 103 sandwiching each piezoelectric layer 102 are let to be at the same electric potential during which the electric field is generated in the piezoelectric layer 102, this electric field is vanished, and the piezoelectric layer 102 contracts from an elongated state to a state before elongation. Accordingly, the line head 3 moves to a right side in the diagram.

Fifth Modified Embodiment

Figure 15:
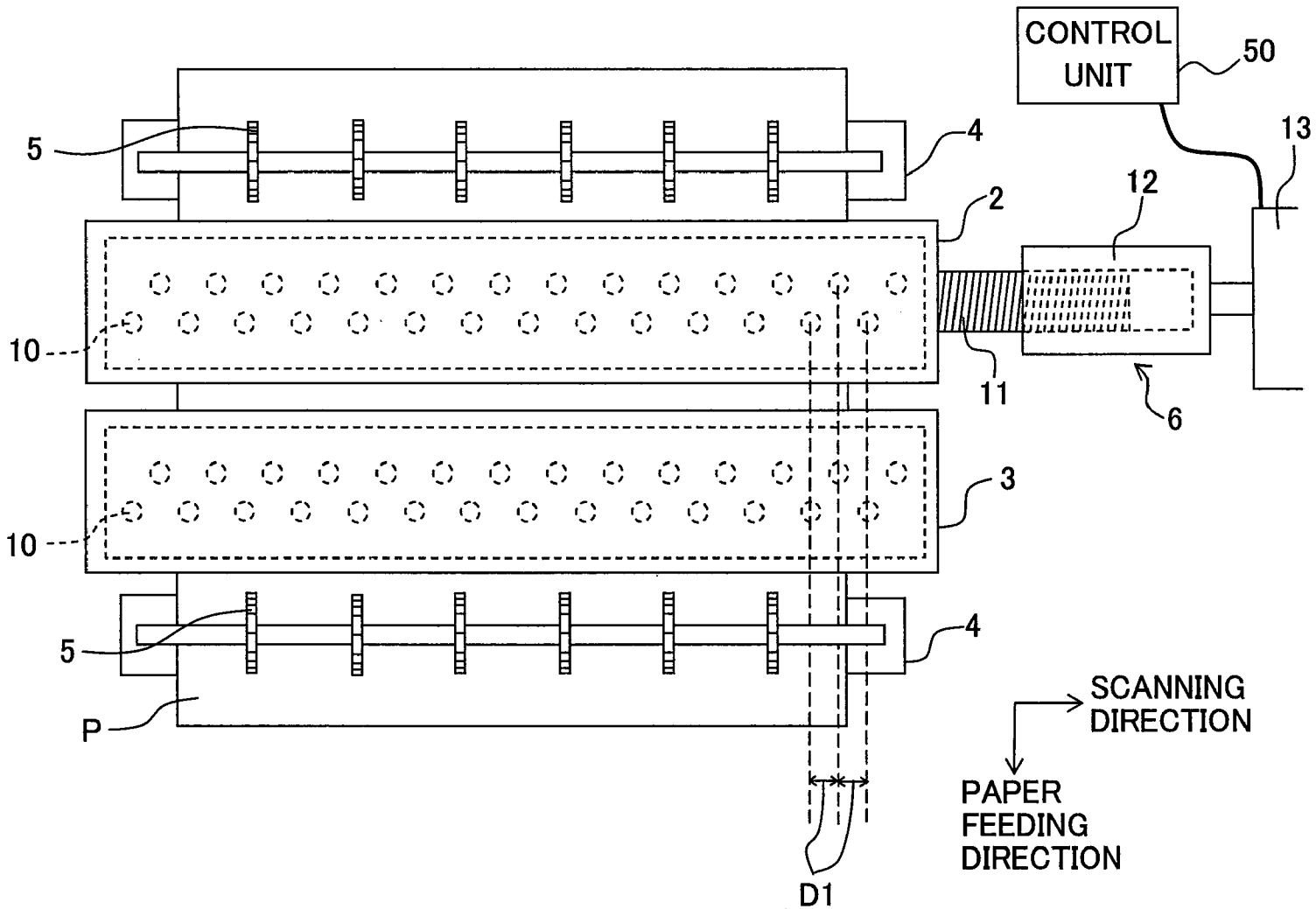
FIG. 15 shows a diagram of the fifth modified embodiment corresponding to FIG. 1.

In the abovementioned description, the line head 2 is fixed to the printer, and the line head 3 is movable in the scanning direction by the head moving mechanism 6. However, the present invention is not restricted to such an arrangement. As shown in FIG. 15, the line head 3 may be fixed to the printer, and the line head 2 may be movable in the scanning direction by the head moving mechanism 6.

Sixth Modified Embodiment

Figure 16:
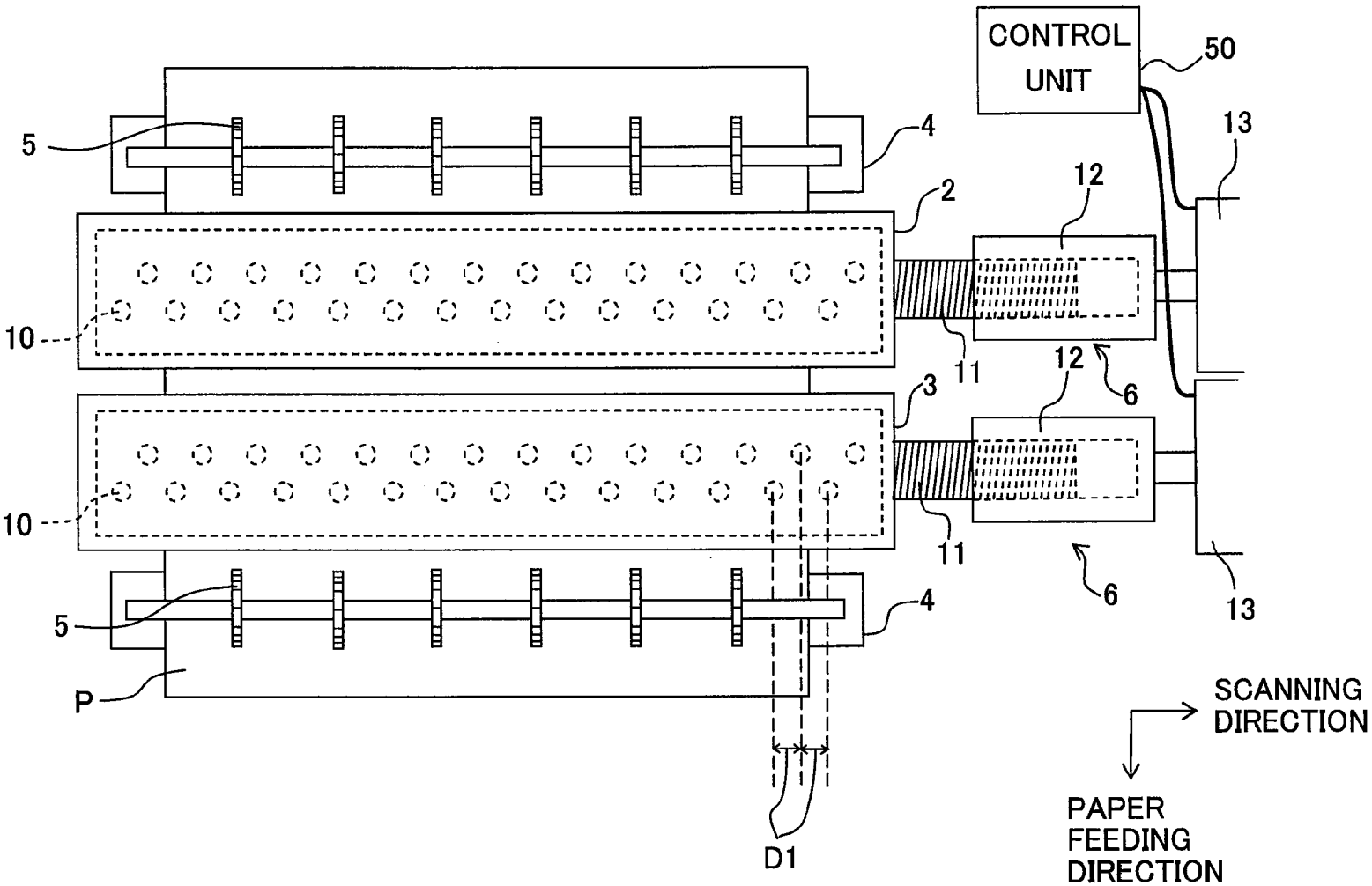
FIG. 16 shows a diagram of the sixth modified embodiment corresponding to FIG. 3.

As shown in FIG. 16, the head moving mechanism 6 may be provided separately to both the line heads 2 and 3, and the line heads 2 and 3 may be movable independently in the scanning direction.

Second Embodiment

Next, a second embodiment according to the present invention will be described below. Since a structure of a printer according to the second embodiment is similar to the structure of the printer 1 according to the first embodiment except for the following points. The printer does not include the defective-nozzle detecting unit 7 (refer to FIG. 2), a control unit 150 differs from the control unit 50 of the first embodiment, and a print instruction signal which is to be input to the control unit 150 includes a printing-mode instruction signal which instructs as to which of a high-speed printing mode and a high image quality printing mode is to be printed, only the control unit 150 will be described below.

Figure 17:
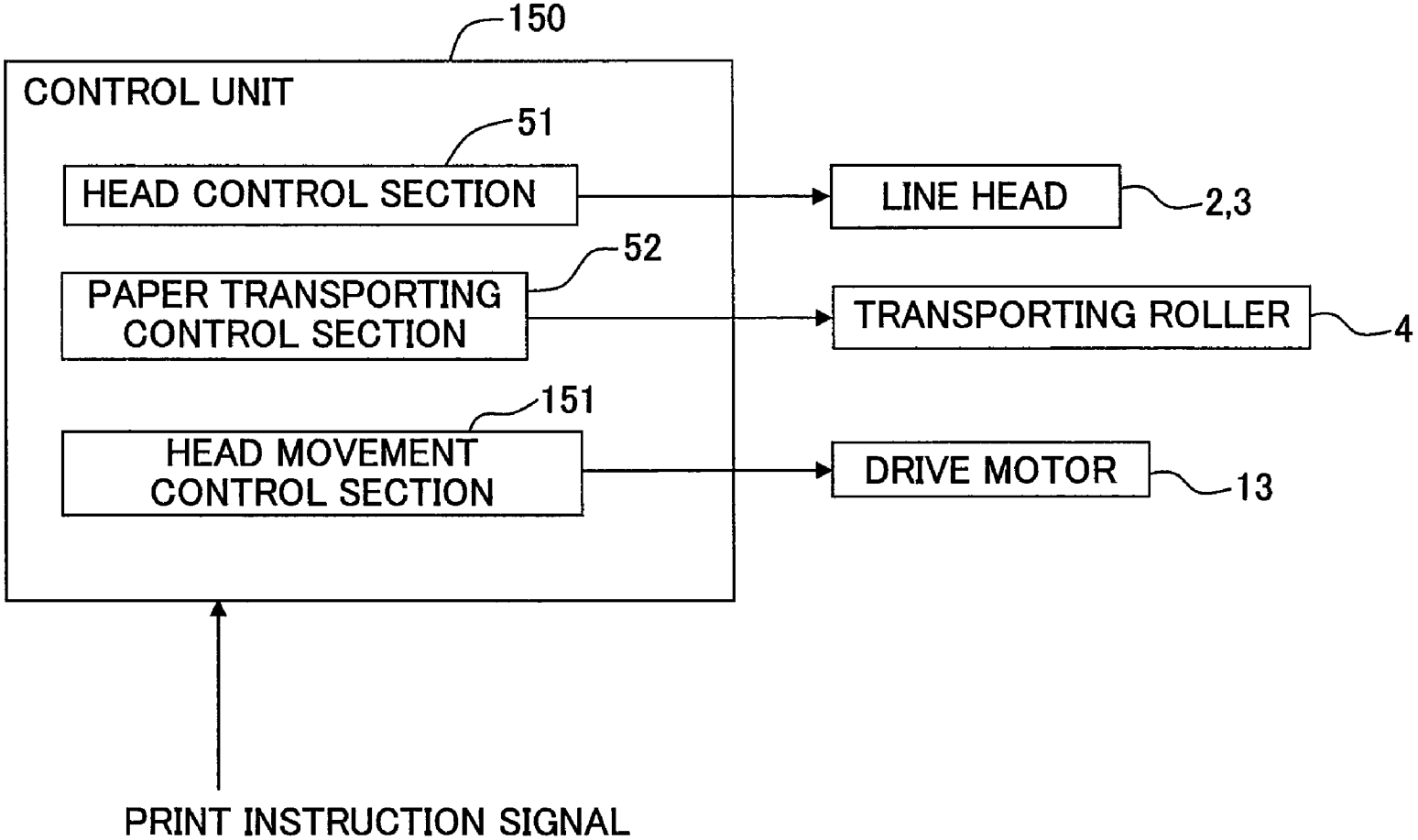
FIG. 17 shows a diagram of the second embodiment corresponding to FIG. 3.

FIG. 17 is a block diagram of the control unit 150. As shown in FIG. 17, the control unit 150 includes the head control section 51, the paper transporting control section 52 similarly as in the control unit 50 (refer to FIG. 3), and a head movement control section 151 instead of the head movement control section 56 (refer to FIG. 3). The control unit 150 does not include the defective-nozzle detecting unit control section 53, the defective-nozzle information acquiring section 54, and the amount of movement calculating section 55 as in the control unit 50 (refer to FIG. 3).

The head movement control section 151 moves the line head 3 by controlling an operation of the drive motor 13, based on a content of the printing mode instruction signal in the print instruction signal which has been input.

Concretely, when the printing mode instruction signal instructs to carry out printing in the high-speed printing mode, as shown in FIG. 6, the head movement control section 151 controls the drive motor 13 to move the line head 3 such that the nozzles 10 of the line head 2 and the nozzles 10 of the line head 3 are at the same position in the scanning direction.

Moreover, in a state of the line head 3 at this position, printing is carried out on the recording paper P by jetting the ink from the nozzles 10 of the line heads 2 and 3 such that the ink jetted from the nozzles 10 of the line head 2 and the ink jetted from the nozzles 10 of the line head 3 land alternately in the scanning direction and the paper feeding direction as shown in FIG. 6. In this manner, since the ink is to be jetted on each point of the recording paper P at which the ink is to be made to land, from any one of the nozzles 10 of the line head 2 and the nozzles 10 of the line head 3, it is possible to carry out printing on the recording paper P at a high speed as compared to a case in which the printing is carried out by using any one of the line heads 2 and 3.

Figure 18:
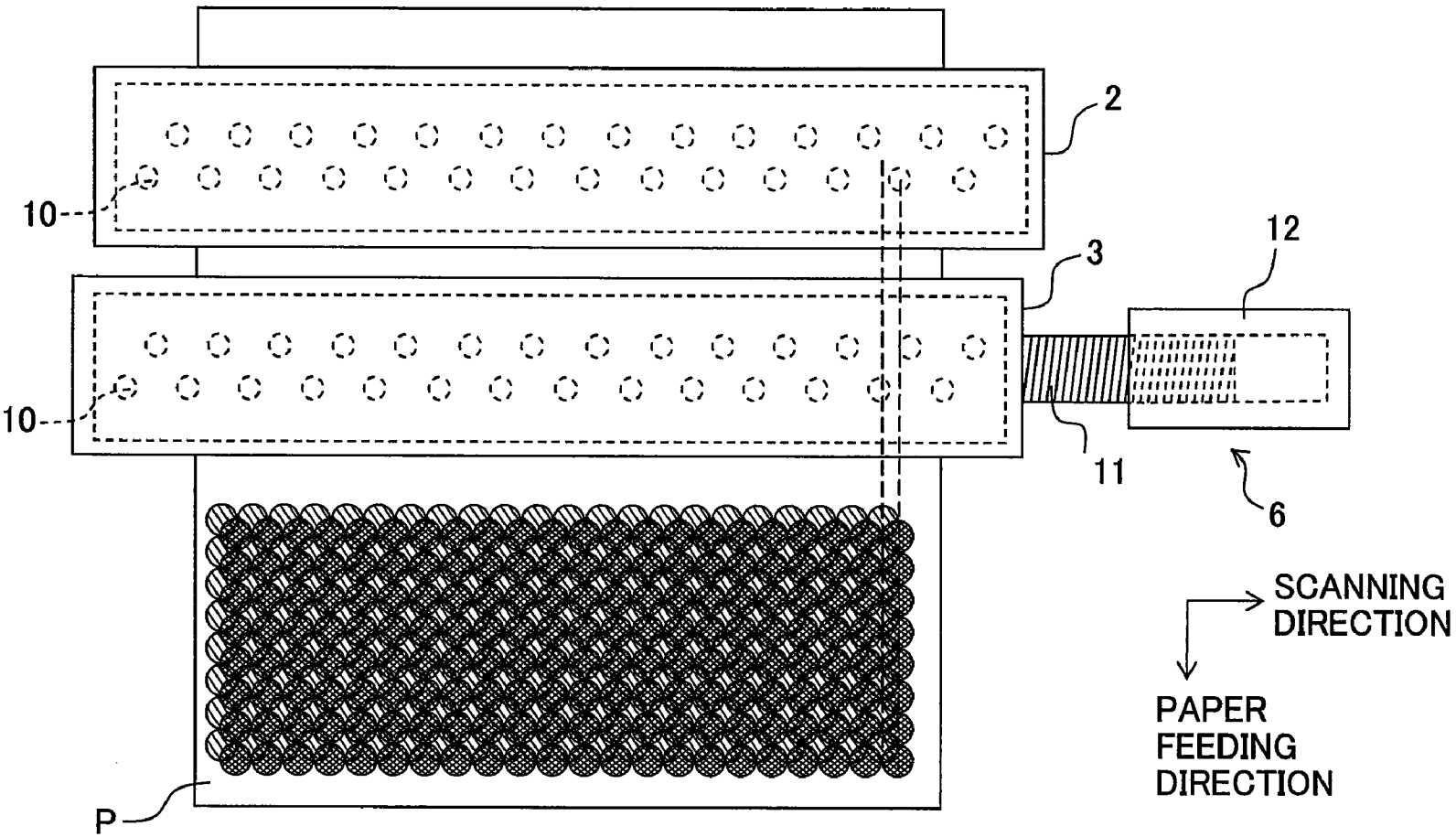
FIG. 18 shows a diagram printed in the high-quality mode in the second embodiment corresponding to FIG. 5.

On the other hand, when the printing mode instruction signal instructs to carry out printing in the high image quality printing mode, as shown in FIG. 18, the head movement control section 151 controls the drive motor 13 to move the line head 3 such that the nozzles 10 of the line head 3 come between the nozzles 10 of the line head 2 in the scanning direction. In other words, the line head 3 is moved such that the nozzles 10 of the line head 2 and the nozzles 10 of the line head 3 are arranged to be shifted mutually in the scanning direction.

In a state of the line head 3 at this position, printing is carried out on the recording paper P by jetting the ink from the nozzles of the line heads 2 and 3. At this time, the ink jetted from the nozzles 10 of the line head 3 lands between the ink which has landed on the recording paper P upon being jetted from the nozzles 10 of the line head 2. Therefore, as compared to a case in which the printing is carried out by using any one of the line heads 2 and 3, an image which is printed becomes a high quality image.

In such manner, the head movement control section 151, according to whether the printing is to be carried out in the high-speed printing mode or in the high image quality printing mode, moves the line head 3 by controlling the drive motor 13 in order to select a position such that the nozzles 10 of the two line heads 2 and 3 come to the same position in the scanning direction, and another position such that the nozzles 10 of the two line heads 2 and 3 come to the shifted positions in the scanning direction (moves the two line heads 2 and 3 relatively). Accordingly, in a printer having two line heads 2 and 3, it is possible to carry out both types of printing namely, a high-speed mode in which the printing at high speed is performed as compared to a case in which the printing is carried out by only one of the line heads 2 and 3, and a high-quality mode in which the printing with a high image quality is performed as compared to a case of carrying out printing by only one of the line heads 2 and 3.

According to the second embodiment described above, in a printer having two line heads 2 and 3, by moving the line head 3 such that the nozzles 10 of the line head 2 and the nozzles 10 of the line head 3 come to the same positions in the scanning direction, it is possible to carry out printing at a high speed as compared to the case in which the printing is carried out by only one of the line heads 2 and 3. Moreover, in this printer, by moving the line head 3 such that the nozzles 10 of the line head 2 and the nozzles 10 of the line head 3 are arranged at mutually misaligned positions, it is possible to carry out printing with a high image quality as compared to the case of carrying out printing by only one of the line heads 2 and 3.

Next, a modified embodiment in which a modification is made in the second embodiment will be described below. However, same reference numerals are assigned to components having a structure similar as in the second embodiment, and description of such components is omitted.

Even in the second embodiment, similarly as in the first embodiment, the line head 2 is fixed to the printer, and the line head 3 is movable in the scanning direction. However, the present invention is not restricted to such an arrangement, and similarly as in the fifth modified embodiment and the sixth modified embodiment described above, the line head 3 may be fixed to the printer, and the line head 2 may be movable in the main scanning direction by the head moving mechanism 6. Or, the head moving mechanism 6 may be provided separately to both the line heads 2 and 3, and the line heads 2 and 3 may be movable independently in the scanning direction.

In the embodiments and the modified embodiments described above, the black ink has been jetted from the two line heads. However, the present invention is not restricted to such arrangement. For example, the present invention may be applied to a line head which jets an ink (such as a color ink) other than the black ink. Or, the ink-jet printer according to the present invention may have two line heads which jet the black ink, and two color line heads which jet a color ink. Nozzles which jet inks of plurality of colors may be formed in one color line head, or may be formed as separate line heads for each color. When the ink-jet printer has a set of two abovementioned line heads for each color, a position adjustment of the two line heads may be carried out for each color, and a position adjustment may be carried out for all colors simultaneously.

In the embodiments and the modified embodiments described above, the description has been made by citing the line head which prints in a stationary state with respect to the ink-jet printer main body. However, the present invention is not restricted to such arrangement. For instance, the present invention is also applicable to a liquid droplet jetting head used in a liquid droplet jetting apparatus which jets an electroconductive liquid on to a large-size liquid crystal substrate. In this case, during printing, the two liquid droplet jetting heads are not stationary with respect to the liquid droplet jetting apparatus, and are mounted on a carriage which is relatively movable with respect to the liquid crystal substrate. However, while the two liquid droplet jetting heads jet liquid droplets by moving relatively with respect to the liquid crystal substrate, a relative position of the two liquid droplet jetting heads is invariable (does not change). In other words, while the two liquid droplet jetting heads of the liquid droplet jetting apparatus according to the present invention jet liquid droplets upon being mounted on a common carriage, a positional relationship of the two liquid droplet jetting heads is maintained. At this point, the liquid droplet jetting apparatus according to the present invention differs substantially from a liquid droplet jetting apparatus which has only two serial liquid droplet jetting heads.

In the description made above, an example in which the present invention is applied to a printer which carries out printing by jetting the ink from nozzles has been described. However, the application of the present invention is not restricted to this, and the present invention is also applicable to a liquid droplet jetting apparatus which jets a liquid other than ink from the nozzles.

What is claimed is:

1. A liquid droplet jetting apparatus which jets liquid droplets onto an object, comprising:

a transporting mechanism which transports the object along a transporting path extended in a predetermined transporting direction;

two heads each having a plurality of nozzles arranged in a row in an intersecting direction intersecting with the transporting direction, the two heads each jetting the liquid droplets from the nozzles while maintaining a relative position of the two heads, the two heads each jetting the liquid droplets from the nozzles onto the object even when no defective nozzle has been found;

a head relative-position changer which changes the relative position of the two heads between a first relative position and a second relative position which is different from the first relative position in the intersecting direction; and a defective-nozzle information acquiring mechanism which acquires defective-nozzle information indicating a defective nozzle, among the nozzles of both of the two heads, that is defective in liquid-droplet jetting;

wherein the two heads are line heads which jet the liquid droplets while being stationary relative to the liquid droplet jetting apparatus;

wherein lengths, in the intersecting direction, of areas in the two heads in which the nozzles are arranged are substantially the same;

wherein the head relative-position changer determines the second relative position based on the defective-nozzle information, such that a defective nozzle of one of the two line heads and a defective nozzle of the other of the two line heads are at different positions with each other in an orthogonal direction which is orthogonal to the transporting direction;

wherein the defective-nozzle information acquiring mechanism optically detects the defective nozzle; and wherein an amount of a liquid droplet, jetted from a certain nozzle of one of the two heads when a nozzle of the other of the two heads which is located at a same position in the orthogonal direction as the certain nozzle of the one of the two line heads is defective, is greater than an amount of a liquid droplet jetted from the certain nozzle of the one of the two heads when the nozzle of the other of the two heads is not defective.

2. The liquid droplet jetting apparatus according to claim 1, further comprising:

a carriage on which the two heads are mounted, and which reciprocates integrally with the two heads, in a direction different from the transporting direction.

3. The liquid droplet jetting apparatus according to claim 1;

wherein one of the two line heads is movable in the intersecting direction, and the other of the two heads is fixed to the transporting path; and wherein the head relative-position changer moves only the one line head in the intersecting direction.

4. The liquid droplet jetting apparatus according to claim 1;

wherein the head relative-position changer moves the two line heads relative to each other in the intersecting direction, only when the defective-nozzle information acquired by the defective-nozzle information acquiring mechanism indicates that the defective nozzle of the one of the two line heads and the defective nozzle of the other of the two line heads are at a same position in the orthogonal direction.

5. The liquid droplet jetting apparatus according to claim 1, further comprising:

a defective-nozzle detecting mechanism which detects a defective nozzle in each of the two line heads;

wherein the defective-nozzle information acquiring mechanism acquires the defective-nozzle information based on a detection result of the defective-nozzle detecting mechanism.

6. A liquid droplet jetting apparatus which jets liquid droplets onto an object, comprising:

a transporting mechanism which transports the object along a transporting path extended in a predetermined transporting direction;

two heads each having a plurality of nozzles arranged in a row in an intersecting direction intersecting with the transporting direction, the two heads each jetting the liquid droplets from the nozzles while maintaining a relative position of the two heads;

a head relative-position changer which changes the relative position of the two heads between a first relative position and a second relative position which is different from the first relative position in the intersecting direction; and a defective-nozzle information acquiring mechanism which acquires defective-nozzle information indicating a defective nozzle, among the nozzles of both of the two heads, that is defective in liquid-droplet jetting;

wherein the two heads are line heads which jet the liquid droplets while being stationary relative to the liquid droplet jetting apparatus;

wherein lengths, in the intersecting direction, of areas in the two heads in which the nozzles are arranged are substantially the same;

wherein the head relative-position changer determines the second relative position based on the defective-nozzle information, such that a defective nozzle of one of the two line heads and a defective nozzle of the other of the two line heads are at different positions with each other in an orthogonal direction which is orthogonal to the transporting direction;

wherein the defective-nozzle information acquiring mechanism optically detects the defective nozzle; and wherein the nozzles of the two line heads are arranged with a constant nozzle interval in the orthogonal direction; and wherein the head relative-position changer determines the two relative positions such that the defective nozzle of the one of the two line heads and the defective nozzle of the other of the two line heads are at positions separated away from each other in the orthogonal direction by a distance which is not less than twice the nozzle interval.

7. The liquid droplet jetting apparatus according to claim 6;

wherein the head relative-position changer determines the second relative position such that an amount of movement of the two line heads is minimum.

8. The liquid droplet jetting apparatus according to claim 6;

wherein the head relative-position changer determines the second relative position such that the defective nozzle of the one of the two line heads and the defective nozzle of the other of the two line heads arc at positions separated away from each other only by the nozzle interval in the orthogonal direction, when it is not possible to arrange the two defective nozzles of the two line heads at positions to be separated by the distance which is not less than twice the nozzle interval in the orthogonal direction.

9. The liquid droplet jetting apparatus according to claim 1;

wherein the head relative-position changer is capable of moving the two line heads, in the intersecting direction, to a plurality of positions at which relative positions of the two line heads are different from each other;

wherein the liquid droplet jetting apparatus is capable of carrying out a test-pattern formation mode of forming, on the object, a plurality of test patterns corresponding to the positions by jetting the liquid droplets onto the object from the nozzles in a state that the two line heads are moved to the positions;

wherein the liquid droplet jetting apparatus further comprises an input section which is capable of inputting position information corresponding to a test pattern among the test patterns which is selected by a user; and wherein the head relative-position changer determines the second relative position based on the position information inputted from the input section.

10. The liquid droplet jetting apparatus according to claim 1;

wherein the head relative-position changer determines the first position such that the nozzles of the two line heads are located at a same position in the orthogonal direction, and determines the second position such that the nozzles of the two line heads are located at mutually shifted positions in the orthogonal direction.

11. A liquid droplet jetting apparatus which jets liquid droplets onto an object, comprising:

a transporting mechanism which transports the object along a transporting path extended in a predetermined transporting direction;

two heads each having a plurality of nozzles arranged in a row in an intersecting direction intersecting with the transporting direction, the two heads each jetting the liquid droplets from the nozzles while maintaining a relative position of the two heads, the two heads each jetting the liquid droplets from the nozzles onto the object even when no defective nozzle has been found;

a head relative-position changer which changes the relative position of the two heads between a first relative position and a second relative position which is different from the first relative position in the intersecting direction; and a defective-nozzle information acquiring mechanism which acquires defective-nozzle information indicating a defective nozzle, among the nozzles of both of the two heads, that is defective in liquid-droplet jetting;

wherein the two heads are line heads which jet the liquid droplets while being stationary relative to the liquid droplet jetting apparatus;

wherein lengths, in the intersecting direction, of areas in the two heads in which the nozzles are arranged are substantially the same;

wherein, before a first printing pass of the object though the liquid droplet jetting apparatus, the head relative-position changer determines the second relative position based on the defective-nozzle information, such that a defective nozzle of one of the two line heads and a defective nozzle of the other of the two line heads are at different positions with each other in an orthogonal direction which is orthogonal to the transporting direction during the first printing pass of the object though the liquid droplet jetting apparatus; and wherein the defective-nozzle information acquiring mechanism optically detects the defective nozzle.

* * * * *